US006669068B2

(12) United States Patent
Kawakita

(10) Patent No.: US 6,669,068 B2
(45) Date of Patent: Dec. 30, 2003

(54) EXTENDABLE STRAP AND BAG PROVIDED WITH THE SAME

(76) Inventor: Kijuro Kawakita, B504, 482-22, Hasama 2-chome, Funabashi-shi, Chiba (JP), 274-0822

( * ) Notice: Subject to any disclaimer, the term of this patent is extended or adjusted under 35 U.S.C. 154(b) by 110 days.

(21) Appl. No.: 10/098,589

(22) Filed: Mar. 18, 2002

(65) Prior Publication Data

US 2002/0129439 A1 Sep. 19, 2002

(30) Foreign Application Priority Data

Mar. 17, 2001 (JP) ..... 2001-123619

(51) Int. Cl.[7] ..... A45C 13/26; A45C 13/30

(52) U.S. Cl. ..... 224/578; 224/579; 224/258; 224/908; 224/930; 150/108; 16/114.1

(58) Field of Search ..... 224/908, 930, 224/258, 578, 257, 279, 600, 627; 150/107, 108; 16/114.1, 405; 294/141; 190/115, 117

(56) References Cited

U.S. PATENT DOCUMENTS

| | | | | | |
|---|---|---|---|---|---|
| 649,832 | A | * | 5/1900 | Furnivall | 16/405 |
| 1,640,522 | A | * | 8/1927 | White et al. | 150/108 |
| 2,247,867 | A | * | 7/1941 | Baumann | 224/258 |
| 3,117,607 | A | * | 1/1964 | Siegel | 150/117 |
| 3,559,853 | A | * | 2/1971 | Strassman | 224/258 |
| 3,912,141 | A | * | 10/1975 | Appel | 150/108 |
| 5,294,029 | A | * | 3/1994 | Shimura et al. | 224/162 |
| 5,370,286 | A | * | 12/1994 | Newman | 224/578 |
| 5,603,545 | A | * | 2/1997 | Benson et al. | 294/150 |
| 5,713,439 | A | * | 2/1998 | Zionts et al. | 190/102 |
| 5,897,039 | A | * | 4/1999 | Swenke | 224/162 |
| 5,950,893 | A | * | 9/1999 | Heggeland | 224/578 |
| 6,047,443 | A | * | 4/2000 | Komiyama | 16/114.1 |

FOREIGN PATENT DOCUMENTS

| | | | | |
|---|---|---|---|---|
| DE | 4015606 A1 | * | 11/1991 | A45C/11/38 |
| JP | 2-47875 | | 4/1990 | |
| JP | 10-117827 | | 5/1998 | |
| JP | 10-248617 | | 9/1998 | |

* cited by examiner

*Primary Examiner*—Sue A. Weaver
(74) *Attorney, Agent, or Firm*—Nixon & Vanderhye P.C.

(57) ABSTRACT

A strap device has guides 3, 5 in which slits 7*b*, 7*a*, 9*a*, 9*b* are formed with central members 3*b*, 5*b* intervening therebetween. First ends of straps 11, 13 are secured to the central members 3*b*, 5*b* respectively. A second end 11*b* of the strap 11 passes through the slits 9*a*, 9*b*, and then passes through the slit 7*a* of the guide 3. A second end 13*b* of the strap 13 passes through the slits 7*a*, 7*b* of the guide 3, and then passes through the slit 9*a*. When the second ends 11*b*, 13*b* are pulled out in mutually opposite directions, the strap, which has a quadruple length as compared with the spacing distance between the guides, can be instantaneously pulled out. When the strap device 15 is used for a shoulder strap for a bag which has a good appearance.

23 Claims, 19 Drawing Sheets

EXTENDABLE STRAP AND BAG PROVIDED WITH THE SAME

BACKGROUND OF THE INVENTION

1. Field of the Invention

The present invention relates to an extendable/contractible strap and a bag provided with the same.

2. Description of Related Art

A bag, to which a shoulder strap (shoulder belt) is attached, is convenient, for example, when the load of the bag is heavy or when hands of a user are intended to be made free, because the bag can be retained by hanging the shoulder strap on the shoulder. Usually, the shoulder strap is detachably attached to hooks installed at right and left upper end portions of a main bag body. However, when the shoulder strap is not used, the shoulder strap hangs down from the main bag body, which gives an unseemly appearance. Further, the shoulder strap, which hangs down from the main bag body, may be caught by any object or obstacle, possibly resulting in any accident in some cases. Furthermore, when the bag is temporarily placed on the floor in the airport or on the platform of train, the shoulder strap contacts with the floor, which is unfavorable in view of hygiene.

Japanese Patent Application Laid-Open No. 10-117827 discloses a shoulder belt-equipped bag comprising a belt holder provided at a gusset portion of the bag with a belt end which is stickable to the bag by the aid of a Velcro tape. The bag has its shoulder belt which is wound around the outer circumference of the bag. When it is intended to use the shoulder belt, the following operation is performed. That is, the belt end is detached from the bag, and the belt is adjusted to have a desired length. Subsequently, the belt is fixed with the holder. Finally, the belt end is stuck to the bag with the Velcro tape or the like. However, in the case of this bag, it is necessary to attach, to the bag, unique parts such as the belt holder and the Velcro tape. Further, the bag involves the following inconveniences. That is, the bag requires the complicated operation to use the shoulder belt as well as the complicated operation to accommodate the shoulder belt. It is impossible to quickly perform such operations.

A first object of the present invention is to provide a strap and a bag provided with the same wherein the strap is shortened to have a length with which the strap does not hang down from a main bag body when the strap is not used, while the strap can be instantaneously stretched to have a sufficient length when the strap is required.

A second object of the present invention is to provide an extendable strap which is applicable to a variety of ways of use, including, for example, a strap for a portable telephone.

SUMMARY OF THE INVENTION

According to a first aspect of the present invention, there is provided an extendable/contractible strap device (15) comprising a first guide (3) which is formed with a first slit (7*b*) and a third slit (7*a*); a first strap (11) which has a first end (11*a*) connected to the first guide; a second guide (5) which is arranged opposingly to the first guide (3) and which is formed with a second slit (9*a*) and a fourth slit (9*b*); and a second strap (13) which has a first end (13*a*) connected to the second guide; wherein the first strap has a second end (11*b*) which passes through at least one of the second slit and the fourth slit, which returns to the first guide, and which subsequently passes through one of the first slit and the third slit of the first guide, and the second strap has a second end (13*b*) which passes through at least one of the first slit and the third slit, which returns to the second guide, and which subsequently passes through one of the second slit and the fourth slit of the second guide. The first end (11*a*) of the first strap may be connected to an intermediate or central member (3*b*) which is defined between the first slit and the third slit, and the first end (13*a*) of the second strap may be connected to an intermediate or central member (5*b*) which is defined between the second slit and the fourth slit.

According to a second aspect of the present invention, there is provided an extendable/contractible strap (35) comprising a first guide (23) which is defined with a first slit (27*a*); a first strap (31) and a second strap (33) which have first ends (31*a*, 33*a*) connected to the first guide (23) respectively; and a second guide (25) which is arranged opposingly to the first guide and which is defined with a second slit (29*a*); wherein the first strap has a second end (31*b*) which passes through the second slit (29*a*), which returns to the first guide, and which subsequently passes through the first slit (27*a*), and the second strap has a second end (33*b*) which passes through the second slit (29*a*).

According to a third aspect of the present invention, there is provided a bag (150, 180) which is provided with the strap device according to the first or second aspect of the present invention. In this specification, the term "slit" means an opening having a slender and rectangular configuration as well as openings having arbitrary cross-sectional configurations including, for example, circular, elliptic, and square configurations. The term "strap" means a string, a cord, a band or the like having a slender and rectangular cross-sectional configuration as well as strings, cords, bands or the like having arbitrary configurations including, for example, elliptic and circular configurations.

DESCRIPTION OF THE PREFERRED EMBODIMENT OF THE INVENTION

First Embodiment

Figure 1A:
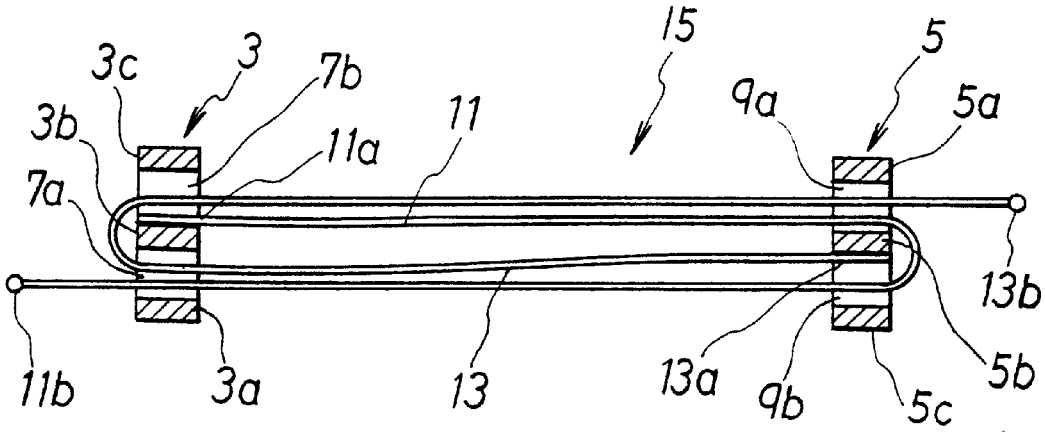
FIG. 1A shows a schematic view illustrating a structure of a strap device of the present invention.

A first embodiment of the strap of the present invention will be explained with reference to FIGS. 1A to 1C, 2A, and 2B. A strap device 15 comprises a first guide 3, a second guide 5, a first strap 11, and a second strap 13. As shown in FIG. 2A, the first guide 3 is a substantially rectangular frame with mutually parallel slits 7*b*, 7*a* which are formed at upper and lower positions respectively with a central member (bridge) 3*b* which intervenes therebetween and which extends in the longitudinal direction at a central portion of the frame. A first end 11*a* of the first strap 11 is secured to the central member 3*b*. The first strap 11 has a width which is slightly narrower than those of the slits 7*a*, 7*b* and a thickness which is not more than ½ of those of the slits. The first strap 11 is composed of a flexible member such as polyethylene or nylon having a smooth surface. As shown in FIG. 2B, the second guide 5 is also a substantially rectangular frame based on the same material and the same structure as those of the first guide 3. The second guide 5 has parallel slits 9*a*, 9*b* which are formed at upper and lower positions with a central member 5*b* intervening therebetween. A first end 13*a* of the second strap 13 is secured to the central member 5*b*. The second strap 13 has the same size as that of the first strap 11, and it is formed of the same material as that of the first strap 11. As shown in FIGS. 7 and 13, the straps 11, 13 may be wound around the central members 3*b* (40*b*, 60*b*), 5*b* respectively, and the first ends 11*a*, 13*a* of the straps may be joined by stitching to the straps themselves.

Figure 2A:
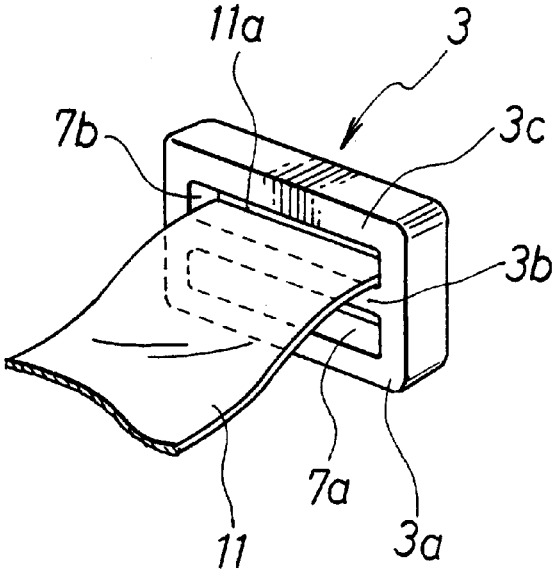
FIGS. 2A and 2B show perspective views illustrating first and second guides respectively.
Figure 2B:
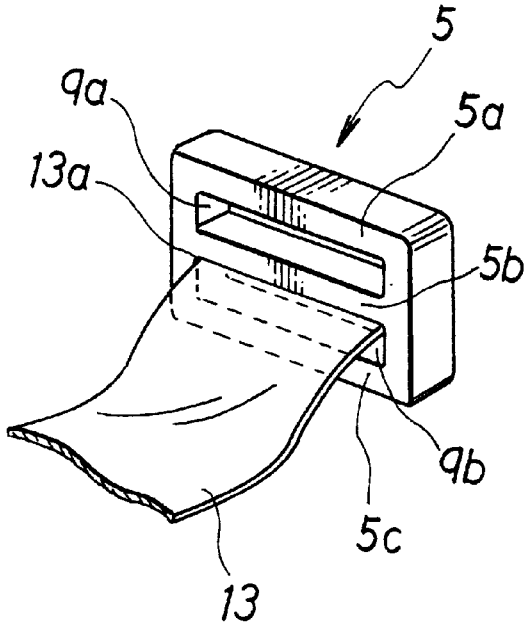

As shown in FIG. 1A, the first guide 3 and the second guide 5 are arranged so that their sides, on which the straps 11, 13 extend, are opposed to one another. A second end 11*b* of the first strap 11, for which the first end 11*a* is secured to the central member 3*b* of the first guide 3, extends toward the second guide 5, and the second end 11*b* passes through the slit 9*a* of the second guide 5. The second end 11*b*, which has passed through the slit 9*a* of the second guide 5, turns back to pass through the slit 9*b*, and the second end 11*b* travels toward the first guide 3. Subsequently, the second end 11*b* passes through the slit 7*a* of the first guide 3, and the second end 11*b* is positioned at the outside of the area which is interposed between the first guide 3 and the second guide 5 (on the outlet side of the first guide). A second end 13*b* of the second strap 13, for which the first end 13*a* is secured to the central member 5*b* of the second guide 5, extends toward the first guide 3, and the second end 13*b* passes through the slit 7*a* of the first guide 3. The second end 13*b*, which has passed through the slit 7*a*, turns back to pass through the slit 7*b*, and the second end 13*b* travels toward the second guide 5. The second end 13*b* passes through the slit 9*a* of the second guide 5, and the second end 13*b* is positioned at the outside of the area which is interposed between the first guide 3 and the second guide 5 (on the outlet side of the second guide).

As appreciated from FIG. 1A, the strap 11 and the strap 13 exist while being folded between the first guide 3 and the second guide 5 respectively. As a result, half portions of the straps 11, 13 are positioned and overlapped quadruply between the first guide 3 and the second guide 5.

Figure 1B:
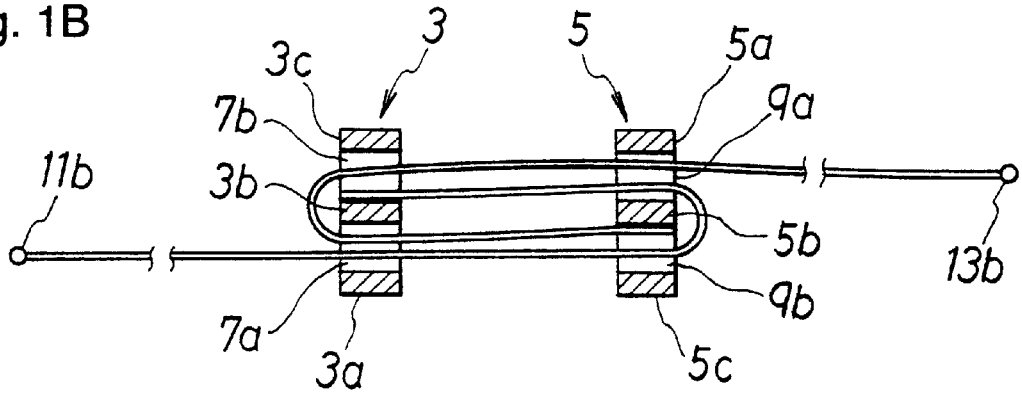
FIG. 1B shows a schematic view illustrating a situation during expansion of the strap device.
Figure 1C:
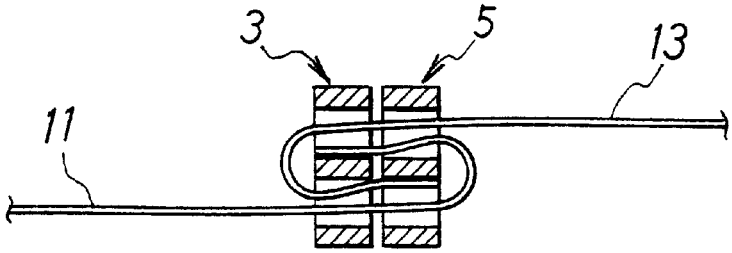
FIG. 1C shows a schematic view illustrating a state in which the strap device is extended.

Next, the operation of the strap device 15 will be explained. Starting from the strap device 15 in the state shown in FIG. 1A, the second ends 11*ib*, 13*b* of the straps 11, 13 are pulled in directions in which they are separated from each other. In consequence, as shown in FIG. 1B, the first and second guides 3, 5 are moved in directions to make approach to one another, while the straps 11, 13 are pulled out from the first and second guides 3, 5. When the second ends 11*b*, 13*b* are further pulled apart so that they are separated from each other, then the first guide 3 and the second guide 5 make mutual abutment as shown in FIG. 1C, and consequently the straps 11, 13 are not pulled out any more. In this situation, almost all of the lengths of the straps 11, 13 are pulled out through the respective guides. The length, which is the double of the spacing distance between the first guide 3 and the second guide 5 in the strap device 15 in the state shown in FIG. 1A, is pulled out from each of the guides. The length, which the quadruple of the spacing distance, is obtained for the entire strap device. In order to restore the strap device 15 into the original state as shown in FIG. 1A, the first guide 3 and the second guide 2, which make the mutual abutment, may be pulled away in mutually opposite directions. Accordingly, the strap, which is extendable to have the quadruple length, is realized.

Second Embodiment

The bag 150 shown in FIG. 3 has a main body 80, and a strap device 98 which is placed on the main body 80 in a state shown in FIG. 1A. The strap device 98 has the same structure as that of the strap device 15 shown in FIG. 1 except that a second strap 13 is longer than a first strap 11 by a predetermined length. The predetermined length is selected on the basis of the thickness of the shoulder of the user. The predetermined length is appropriately 15 to 25 cm. The second ends 11*b*, 13*b* of the first and second straps are secured to end portions on the upper surface of the main bag body 80 respectively. Alternatively, the second ends 11*b*, 13*b* of the first and second straps may be detachably attached to right and left side wall portions of the main bag body 80 by the aid of unillustrated eggplant-shaped fastener rings (rings). A flexible shoulder pad 70 is allowed to pass through a portion of the strap 11 extending from the second guide 5 toward the outside of the strap device (on the outlet side of the second guide). The shoulder pad 70 may be secured to the second guide 5.

Figure 3A:
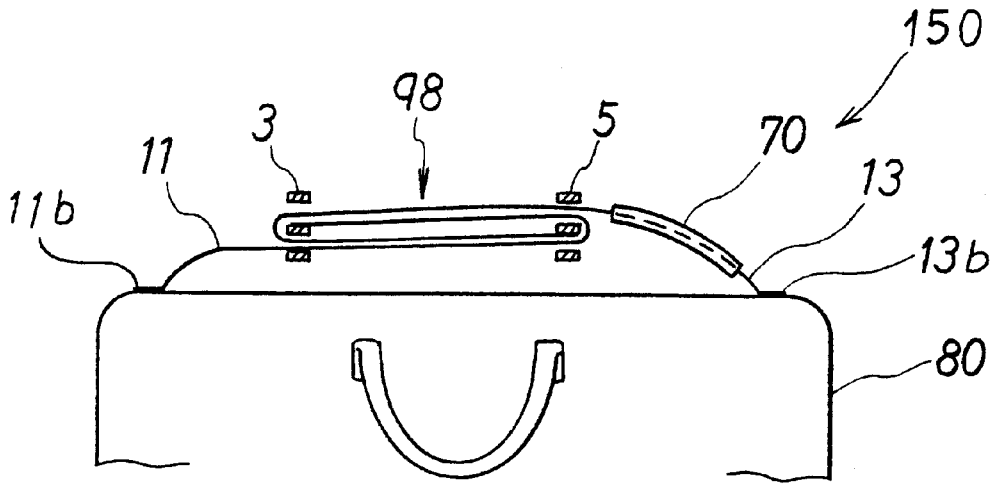
FIG. 3A shows a schematic view illustrating a bag in a state in which the strap device is contracted.
Figure 3B:
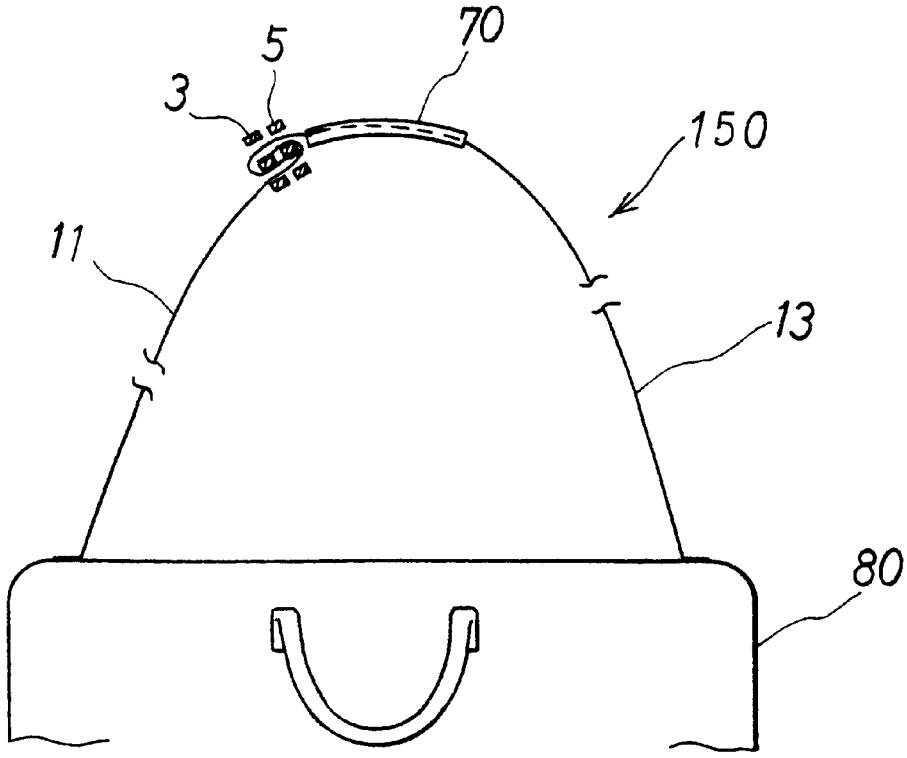
FIG. 3B shows a schematic view illustrating the bag in a state in which the strap device is extended.

In order to use the strap device 98 of the bag 150 shown in FIG. 3A as a shoulder strap, the shoulder pad 70 may be simply pulled up upwardly. During this process, as shown in FIG. 3B, the straps 11, 13 are pulled out from the area between the first guide 3 and the second guide 5 respectively to pull out the length which is about the quadruple of the distance between the first guide and the second guide of the strap device 98 in the state shown in FIG. 3A. The first guide 3 and the second guide 5 are located at positions slightly deviated leftward from the center of the pulled out straps so as to avoid the shoulder position of the user. The pad 70 is slidably moved on the strap 11, and it is located at a substantially central position of the pulled out straps to protect the shoulder of the user. Especially, an advantage is obtained such that the center of the pad is necessarily located at the middle of the shoulder when the pad, which has substantially the same length as that of the predetermined length, is attached. When the shoulder strap is not used, the first and second guides 3, 5 may be pulled away in mutually opposite directions. The straps are instantaneously restored to the state shown in FIG. 3A in accordance with the simple operation.

According to the bag of the present invention, the shoulder strap can be instantaneously pulled out to give a sufficient length from the main bag body only when the shoulder strap is required. When the shoulder strap is unnecessary, then the strap can be restored extremely easily to the state in which the strap is folded on the bag, and the strap does not hang down from the bag. Therefore, the bag, which has the good appearance, which is safe, and which is excellent in functionality, is provided. The strap device of the present invention is usable for any bags having straps or belts, including, for example, brief cases, sports bags, suit cases, garment bags, handbags, knapsacks, tote bags, camera cases, musical instrument cases, and fishing tackle cases. Further, the strap device of the present invention may be attached to any objects to which the shoulder strap is applicable, including apparatuses such as cameras, video cameras, various recording apparatuses, and telescopes, in place of the main bag body.

Third Embodiment

The bag 180 shown in FIG. 4 has a main body 80, and a strap device 95 which is placed on the main body 80 in a state shown in FIG. 1A. The strap device 95 has the same structure as that of the strap device shown in FIG. 1 except that a first strap 11 and a second strap 13 are longer than those shown in FIG. 1A respectively, and their second ends 11*b*, 13*b* are connected to one another. The second ends 11*b*, 13*b* of the first and second straps travel from the first guide 3 and the second guide 5, and then they pass through rings 82, 84 which are secured to the upper surface of the main bag body 80 respectively. The second ends 11*b*, 13*b* are connected to one another after the passage through the rings 82, 84. Accordingly, a strap section 75 is created at the uppermost portion of the strap device. A flexible shoulder pad 70 is allowed to pass through the strap section 75.

Figure 4A:
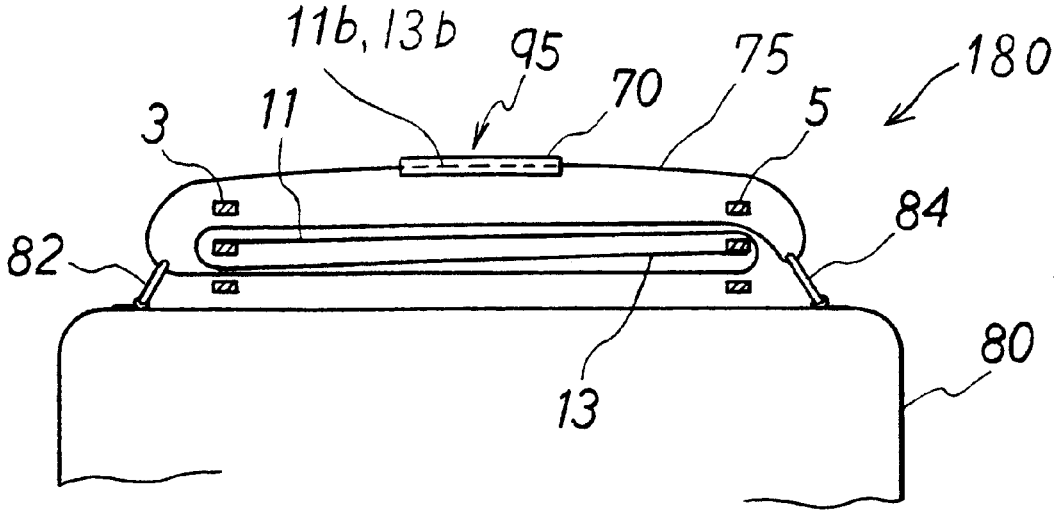
FIG. 4A shows a schematic view illustrating a bag in a state in which the strap device is contracted.
Figure 4B:
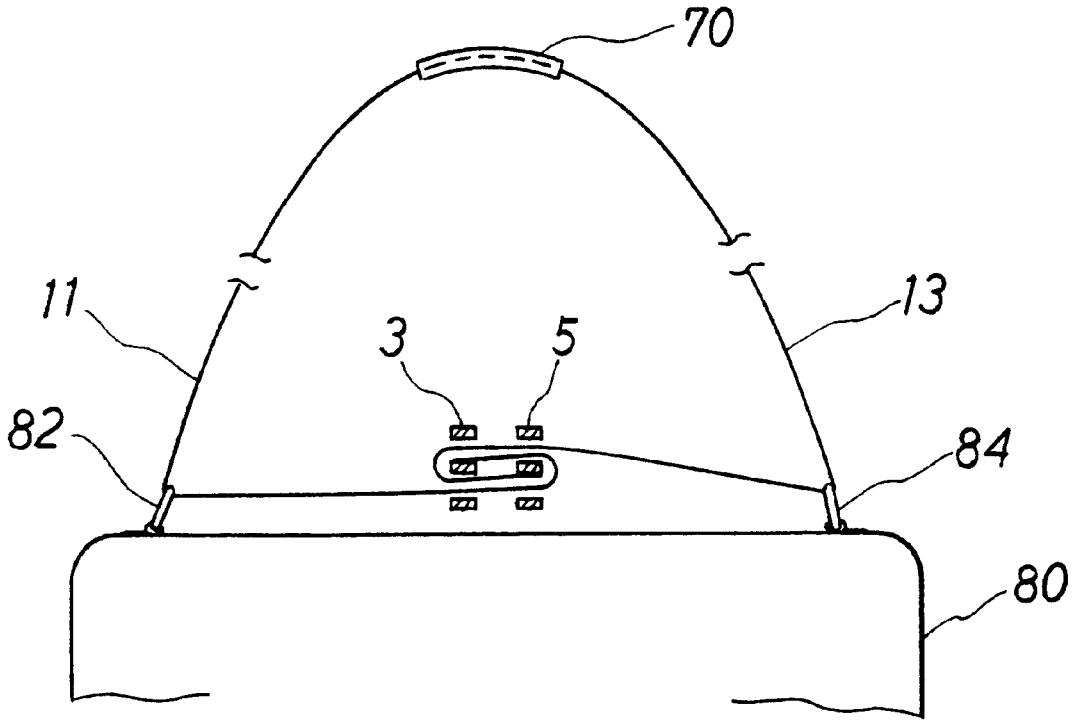
FIG. 4B shows a schematic view illustrating the bag in a state in which the strap device is extended.

In order to use the strap device 95 of the bag 180 shown in FIG. 4A as a shoulder strap, the shoulder pad 70 may be simply pulled up upwardly. As a result, as shown in FIG. 4B, the straps 11, 13 are pulled out from the first guide 3 and the second guide 5 through the rings 82, 84 respectively. In a state shown in FIG. 4B, the length, which is about the quadruple of the distance between the first and second guides of the strap device 95 in the state shown in FIG. 4A, is pulled out. The pad 70 is slidably moved on the strap 11, and it is located at an approximately central position of the pulled out straps to successfully protect the shoulder of the user thereby. In order to make restoration to the state shown in FIG. 4A, the first and third guides 3, 5 may be pulled away from each other.

Fourth Embodiment

Figure 5:
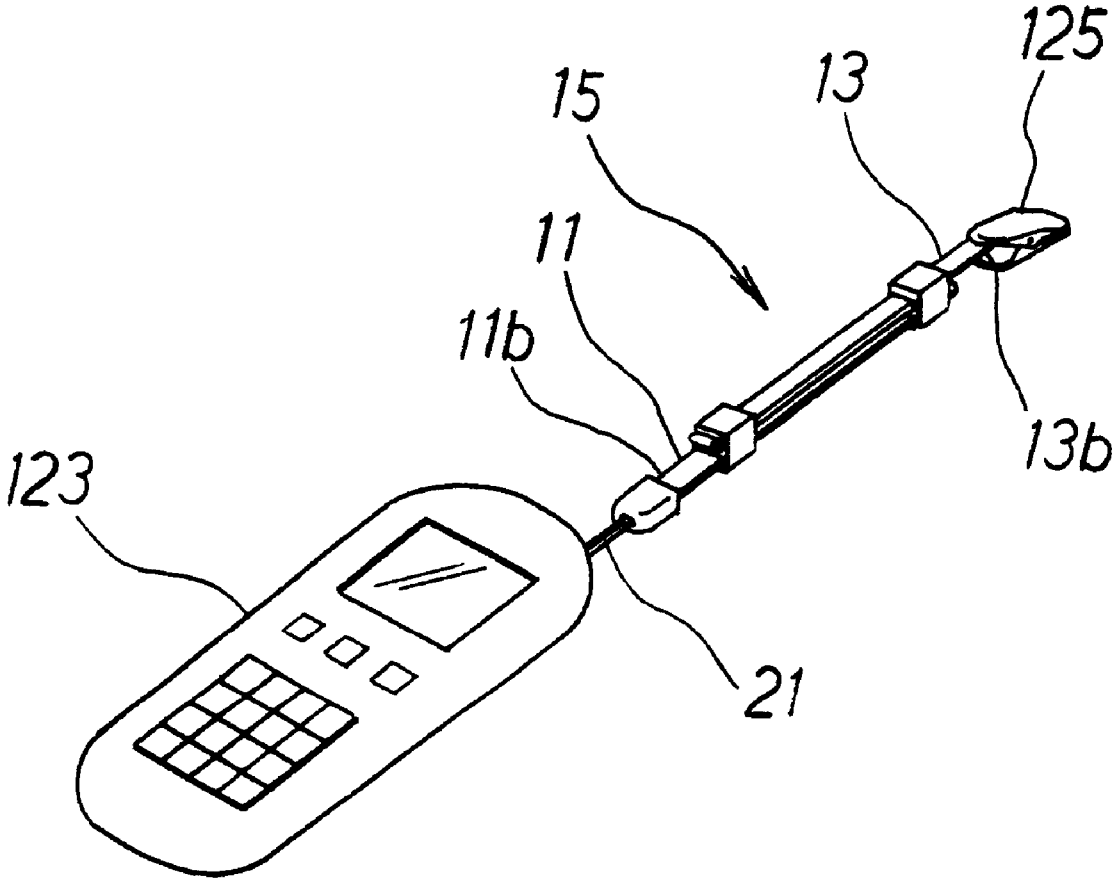
FIG. 5 shows a schematic view illustrating a portable telephone to which the strap device shown in FIG. 1 is installed.

The size of the strap device 15 shown in FIG. 1 may be miniaturized as a whole. As shown in FIG. 5, the second end 11*b* of the first strap 11 may be connected to a portable telephone by the aid of a thin string 21. In this case, the width of the strap is preferably 5 to 8 mm. The second end 13*b* of the second strap 13 may be connected to a clip 125 to pinch a pocket or the like in order to avoid any falling off. When the portable telephone 123, which is accommodated in a chest pocket or a trousers pocket, receives a telephone call, the portable telephone 123 can be taken out of the pocket to make approach to the ear, without disengaging the clip 125 from the pocket. During this operation, the strap is pulled out from the guide. For example, a key, a key holder, a flashlight, a lighter, an azimuth magnet, or a tool may be attached to the strap device in place of the portable telephone 123. A neck-hang type strap may be provided by lengthening the strap length. In the case of the neck-hang type strap, the second ends 11*b*, 13*b* of the straps may be connected to one another by the aid of the clip 125 or without using the clip 125.

Fifth Embodiment

Figure 6A:
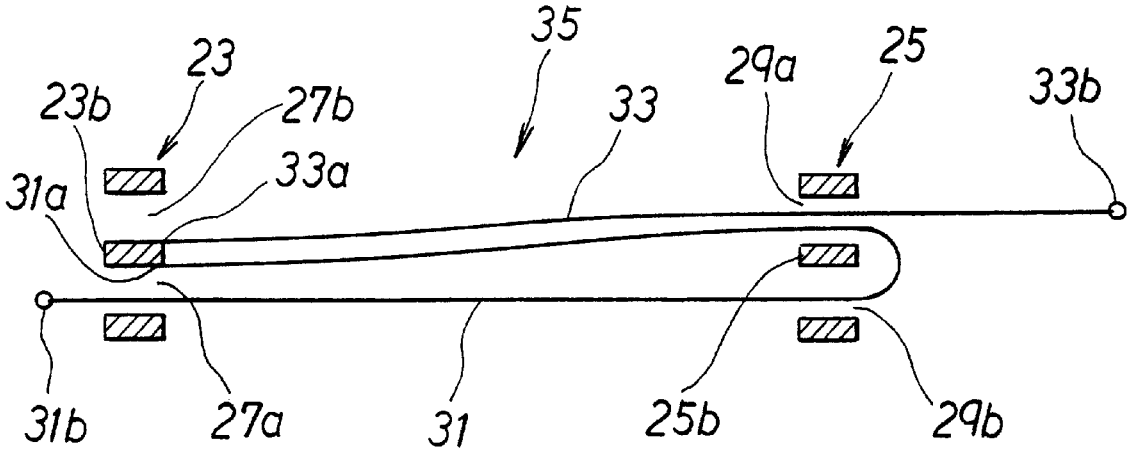
FIG. 6A conceptually shows another strap device of the present invention.
Figure 6B:
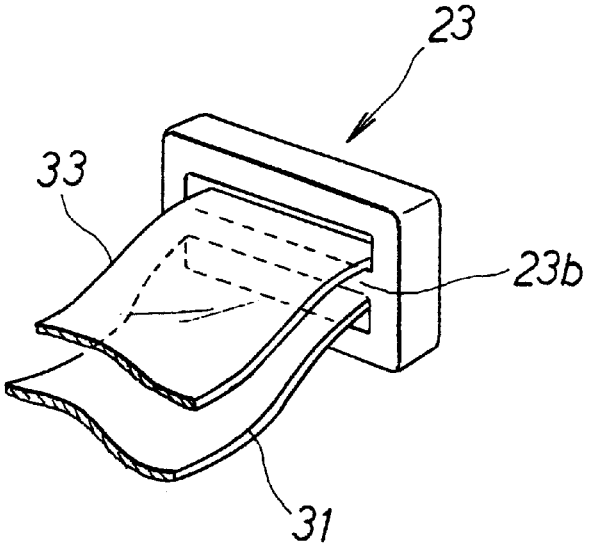
FIGS. 6B and 6C show structures of first and second guides respectively.
Figure 6C:
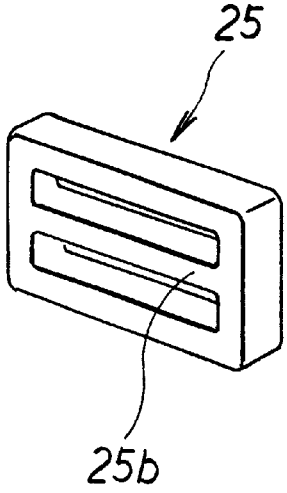

The strap device 35 shown in FIG. 6A is provided with a first guide 23 and a second guide 25 which are opposed to one another. The first guide 23 has a first slit 27*a* and a third slit 27*b* which are formed under and over a central member 23*b* respectively. The first guide 23 is formed as a frame member in the same manner as the first guide 3 shown in FIG. 2A. However, as shown in FIG. 6B, the first guide 23 is different from the first guide 3 shown in FIG. 2A in that a first end 31*a* of a first strap 31 and a first end 33*a* of a second strap 33 are secured to a lower surface and an upper surface of the central member 23*b* of the first guide 23 respectively. A second guide 25 has second slits 29*a*, 29*b* which are formed over and under a central member 25*b* respectively. The second guide 25 is formed of the same frame member as that of the second guide 5 shown in FIG. 2B. However, as shown in FIG. 6C, the second guide 25 is different from the second guide 5 shown in FIG. 2B in that a second end 33*a* of a second strap 33 is not secured to the second guide 25.

A second end 31*b* of the first strap 31 extends from the first guide 23 toward the second guide 25, and it passes through the second slit 29*a*. The second end 31*b* of the first strap 31 turns back, and it passes through the fourth slit 29*b* to return to the first guide. Further, the second end 31*b* of the first strap 31 passes through the third slit 27*a* of the first guide. A second end 33*b* of the second strap 33 extends from the first guide 23 toward the second guide 25, and it passes through the second slit 29*a*. The length of the second strap 33 is slightly longer than the half of the length of the first strap 31. Accordingly, the length of the strap portion protruding to the outer side of the second guide 25 (outlet side) is longer than the length of the strap portion protruding to the outer side of the first guide 23 (outlet side).

The strap device 35 is operated as follows. That is, when the second end 31*b* of the first strap 31 and the second end 33*b* of the second strap 33 are pulled out in directions in which they are separated from each other, then the first guide 23 and the second guide 25 are moved to make approach to one another, and they finally make mutual abutment. In this situation, almost all of the entire lengths of the first strap 31 and the second strap 35 are pulled out from the first guide 23 and the second guide 25 respectively. That is, the strap is pulled out toward the left in the drawing from the first guide 23 to give the length which is about the double of the spacing distance between the first guide and the second guide in the state shown in FIG. 6A. The strap is pulled out toward the right in the drawing from the second guide 25 to give the length which is approximately the same as the spacing distance. The length, which is about the triple of the spacing distance, is obtained as a whole. In order to make restoration to the state shown in FIG. 6A, the first guide 23 and the second guide 25 may be pulled away so that they are separated from each other.

The strap device 35 can be attached to a main bag body in the same manner as in the bag shown in FIG. 3. A pad (70) may be allowed to pass through a second strap portion between the second end 33*b* of the second strap 33 and the second guide 25. When the shoulder strap is required, the pad can be pulled up from the bag to instantaneously stretch the strap. The strap device 35 can be also used as shown in FIG. 4 such that the second ends of the straps may be connected to one another, and a connecting portion may be provided on the bag. Further, alternatively, the size of the strap device 35 may be also miniaturized so that the strap device 35 may be used as a strap for the portable telephone as shown in FIG. 5.

Sixth Embodiment

Figure 7A:
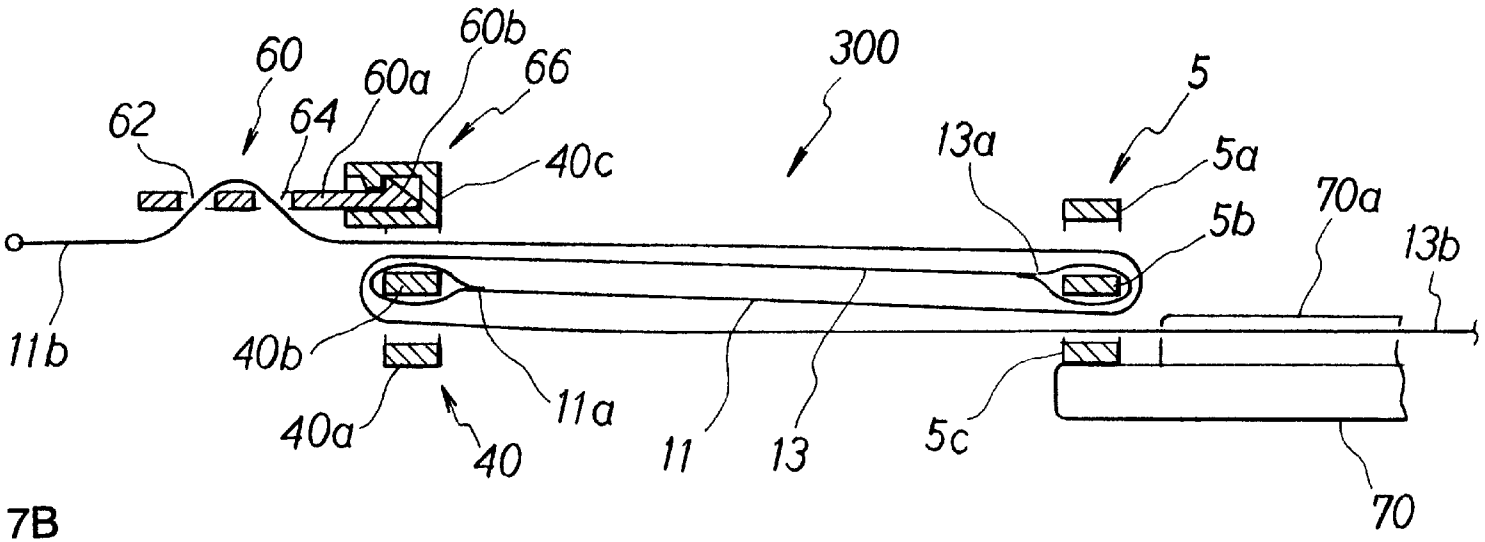
FIG. 7A shows a schematic view illustrating a structure of a strap device according to a sixth embodiment of the present invention.
Figure 7B:
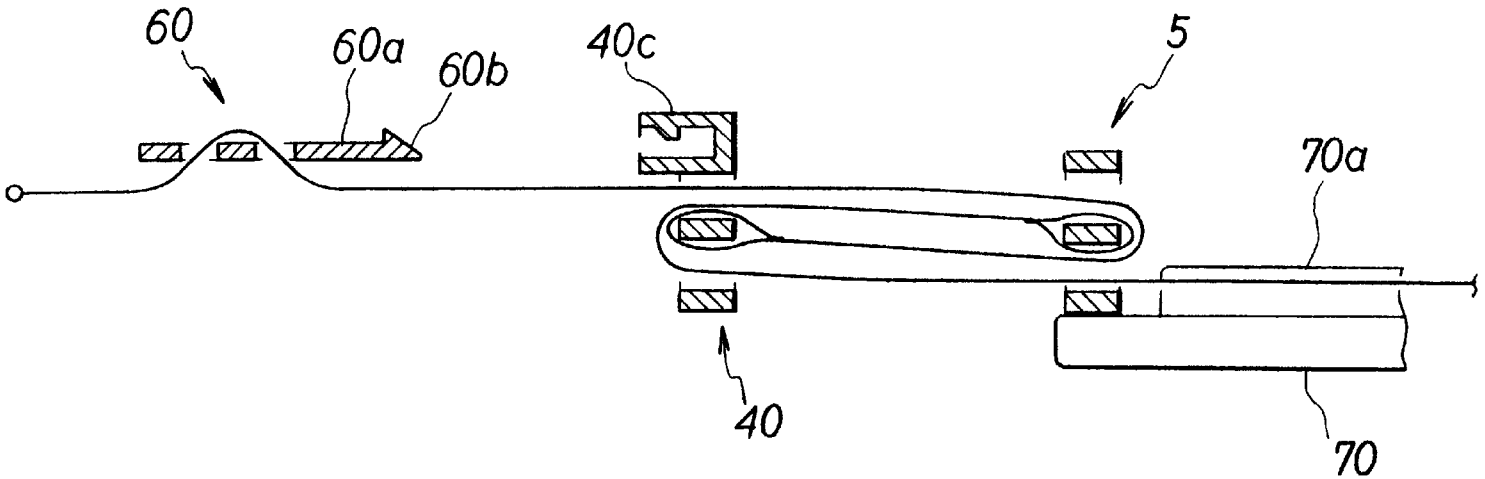
FIG. 7B shows a schematic view illustrating a process of expansion of the strap device shown in FIG. 7A.

The strap device 300 shown in FIGS. 7A and 7B has approximately the same structure as that of the strap device shown in FIG. 3 except that the strap device 300 is provided with a lock mechanism, and a guide 5 is secured to an end portion of a shoulder pad 70. A guide 40, which corresponds to the guide 3 shown in FIG. 3, has a central member 40*b* to which a first end 11*a* of a strap 11 is connected by circumscribing the first end 11*a* therearound and stitching the first end 11*a* and the strap 11 together. A lock adjuster 60 is attached to a strap portion between a second end 11*b* of the strap 11 and the guide 40. Slits 62, 64 are formed through a main body 60*a* of the lock adjuster 60. The second end 11*b* of the strap 11 is allowed to pass through the slits 62, 64, and thus the lock adjuster 60 is attached so that the position of the lock adjuster 60 may be changed on the strap 13. The lock adjuster 60 has a lock pawl 60*b* which is provided at the tip of the main body 60*a* and which is flexibly deformable with respect to the main body 60*a*. An upper frame 40*c* of the guide 40 constitutes an engaging section for making engagement with the lock pawl 60*b*. A lower frame 5*c* of the guide 5 is secured to the-tip of a pad 70. A first end 13*a* of the strap 13 is connected to a central member 5*b* of the guide 5 by circumscribing the first end 13*a* therearound and stretching the first end 13*b* and the strap 13 together. A second end 13*b* of the strap 13 passes through a slit between the central member 40*b* and the upper frame 40*c* of the guide. After that, the second end 13*b* passes through a slit between the lower frame 40*a* and the central member 40*b* of the guide 40 to return to the guide 5. The second end 13*b* passes through a slit between the lower frame 5*c* and the central member 5*b* of the guide 5, and it passes through the space between the pad 70 and a pad cover 70*a* attached to the pad 70.

As shown in FIG. 7A, in the state in which the strap device 300 is contracted, the lock pawl 60*b* of the lock adjuster 60 is engaged with the upper frame 40*c* of the guide 40, and the guide 40 is fixed to the lock adjuster 60. Accordingly, even when any unintentional force is applied to any portion of the strap device 300, especially to the guide 40, the straps are prevented from being loosened, i.e., from being extended to protrude. In order to pull out the straps from the strap device 300, the following operation is performed. That is, the lock pawl 60*b* is flexibly deformed with respect to the main lock adjuster body 60, for example, the lock pawl 60*b* is urged downwardly to disengage the lock pawl 60*b* from the upper frame 40*c* of the guide 40. Subsequently, the pad 70 is pulled up upwardly, or the end 13*b* of the strap is pulled out from the pad cover 70*a*, and thus the straps 11, 13 are pulled out from the area between the guides. As a result of this operation, the guide 40 and the guide 5 make mutual approach as shown in FIG. 7B to extend the strap device. It is noted that the lock mechanism is not limited to the form shown in the drawings. It is possible to adopt various known lock mechanisms. The lock pawl 60*a* may be provided on the side of the guide 40. Alternatively, the lock pawl-engaging section may be provided on the lower frame 40*a* of the guide 40. Further, the engagement between the upper frame 40*c* and the lock pawl of the lock adjuster 60 is not limited to the mechanical engagement, and any magnetic force-based coupling may be adopted. Alternatively, a detachable Velcro tape may be provided for the guide 40 and the strap 11 or the main bag body to connect them.

Seventh Embodiment

Figure 8A:
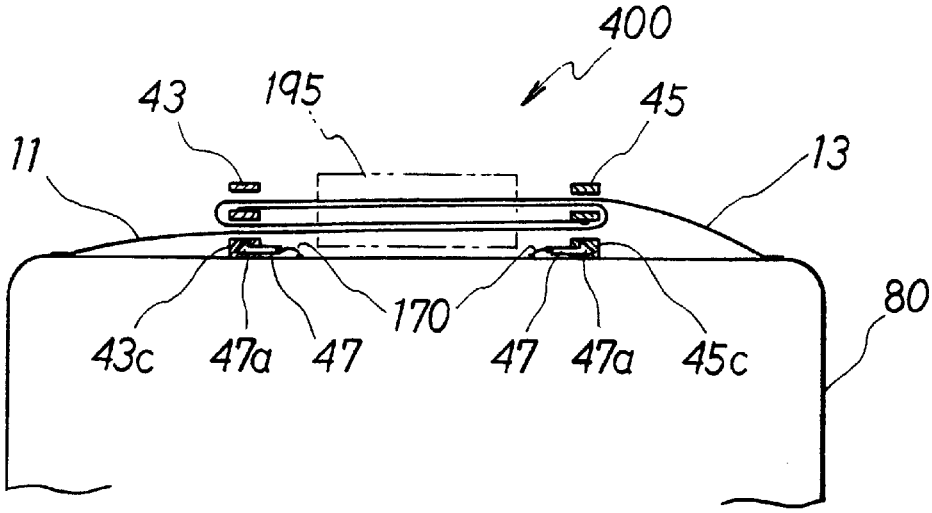
FIG. 8A shows a schematic view illustrating a structure of a bag equipped with a strap device according to a seventh embodiment of the present invention.
Figure 8B:
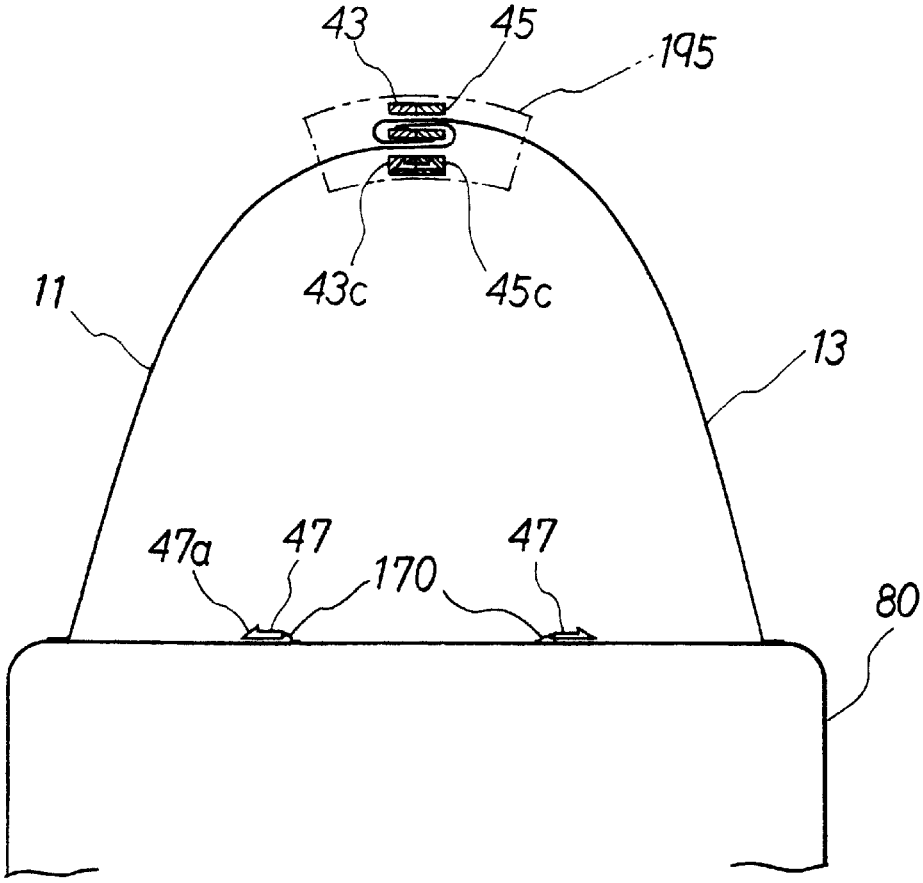
FIG. 8B shows a schematic view illustrating a state in which the strap device shown in FIG. 8A is extended.

The strap device 400 shown in FIGS. 8A and 8B is constructed in the same manner as the strap device shown in FIG. 3 except that the strap device 400 is provided with a lock mechanism and a shoulder pad is provided between guides. As shown in FIG. 8A, a main bag body 80 is provided with a pair of lock members 47 by the aid of short webs 170. Each of the lock members 47 has a lock pawl 47*a* at the tip. Each of the guides 43, 45 has approximately the same structure as that of the guide 40 shown in FIG. 7A. An engaging section, with which the lock pawl 47*a* of the lock member 47 is detachably engageable, is provided for each of lower frames 43*c*, 45*c* of the guides 43, 45.

As shown in FIG. 8A, when the lower frame 43*c* of the guide 43 and the lower frame 45*c* of the guide 45 are engaged with the lock pawls 47*a* respectively, the straps 11, 13 cannot be extended to protrude from the guides 43, 45, because the movement of the guides 43, 45 with respect to the straps 11, 13 is restricted. In this state, the straps (bundle of quadruple straps), which are disposed between the guide 43 and the guide 45, function as a grip. The grip can be gripped more easily by covering the straps 11, 13 with an openable/closable pad cover 195 as shown in FIG. 8A.

In order to use the strap device 400 as a shoulder strap, the pad cover 195 is detached from the strap bundle, and the lock pawls 47*a* are disengaged from the lower frame 43*c* of the guide 43 and the lower frame 45*c* of the guide 45 respectively. Subsequently, the strap bundle is pulled up upwardly. Alternatively, the portions of the straps 11, 13, which are located outside the guides 43, 45, are mutually pulled away. Accordingly, the straps 11, 13 are pulled out from the guides 43, 45 as shown in FIG. 8B. Further, the portion, at which the guides 43, 45 are joined, may be covered with the pad cover 195. That is, in this embodiment, the strap device 400 functions as the grip in the contracted state, and the strap device 400 functions as the shoulder strap in the extended state.

Eighth Embodiment

Figure 9A:
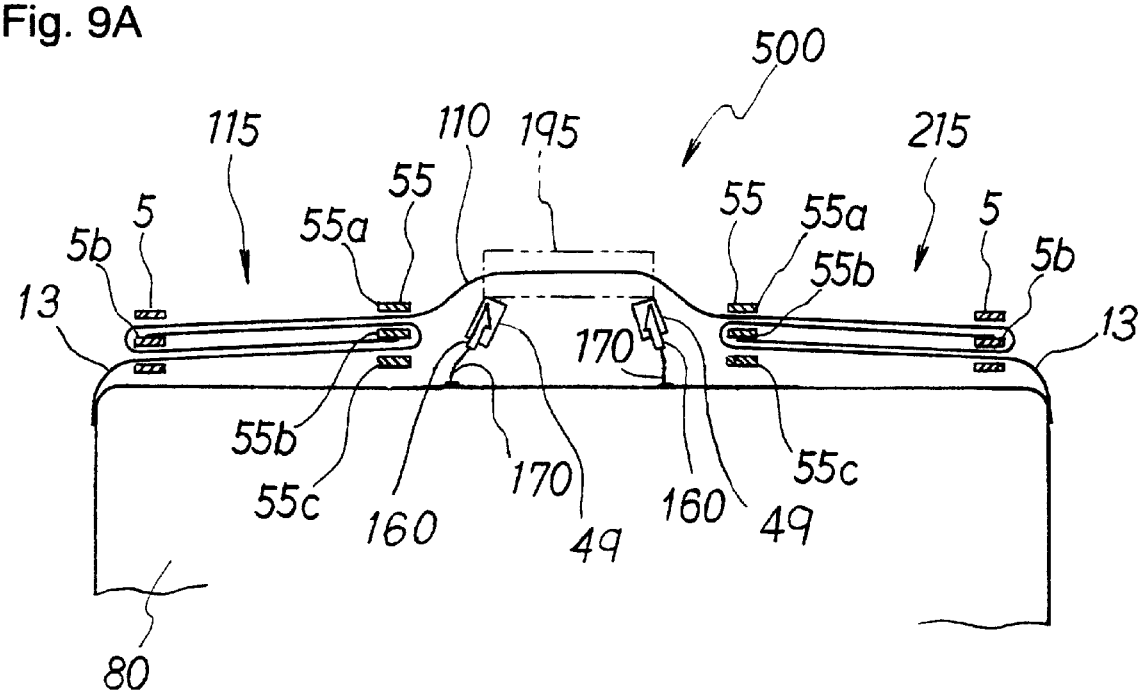
FIG. 9A shows a schematic view illustrating a structure of a bag equipped with a strap device according to an eighth embodiment of the present invention.
Figure 9B:
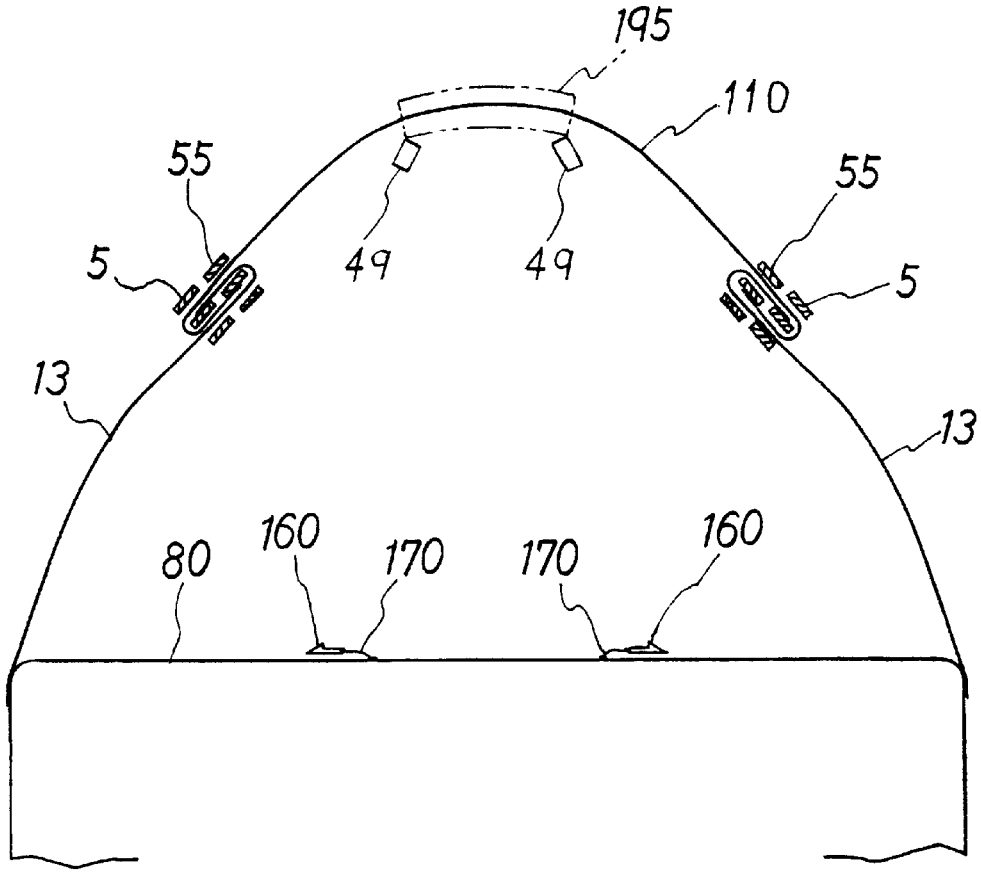
FIG. 9B shows a schematic view illustrating a state in which the strap device shown in FIG. 9A is extended.

A strap device 500 is provided with a pair of strap devices 115, 215 as shown in FIGS. 9A and 9B. Each of the strap devices 115, 215 has the same structure as that of the strap device 15 shown in FIG. 1. Engaging members 49 are provided at both ends of a pad cover 195 which functions as a grip. The engaging members 49 are detachably engageable with lock pawls of a pair of lock members 160 which are provided on a main bag body 80 by the aid of webs 170 respectively. The strap devices 115, 215 include straps 13 having first ends which are connected to side walls of the bag respectively, and second ends which are connected to central members 5*b* of guides 5. A first end of a strap 110 is connected to a central member 55*b* of a guide 55 of the strap device 115. A second end of the strap 110 extends toward the guide 5, and it circumscribes around a central member 5*b* of the guide 5 to make return. The second end of the strap 110 passes through a slit between a central member 55*b* and an upper frame 55*a* of the guide 55, and it is connected to a strap 110 of the strap device 215 at the inside of the pad 195 which is disposed at the center of the bag.

As shown in FIG. 9A, in a state in which the lock pawls of the lock members 160 are engaged with the engaging members 49, the straps 13, 110 of the strap devices 115, 215 cannot be pulled out, and the pad cover 195 functions as the grip. On the other hand, when the lock members 160 are disengaged from the engaging members 49, and the pad cover 195 is subsequently pulled up upwardly, then the straps 11, 13 are pulled out through the guides 5, 55 as shown in FIG. 9B. Thus, the strap devices 115, 215 function as a shoulder strap. In order to make restoration to the state shown in FIG. 9A, the guides 5, 55 of the respective strap devices may be pulled away in directions so that they make separation from each other.

Ninth Embodiment

Figure 10A:
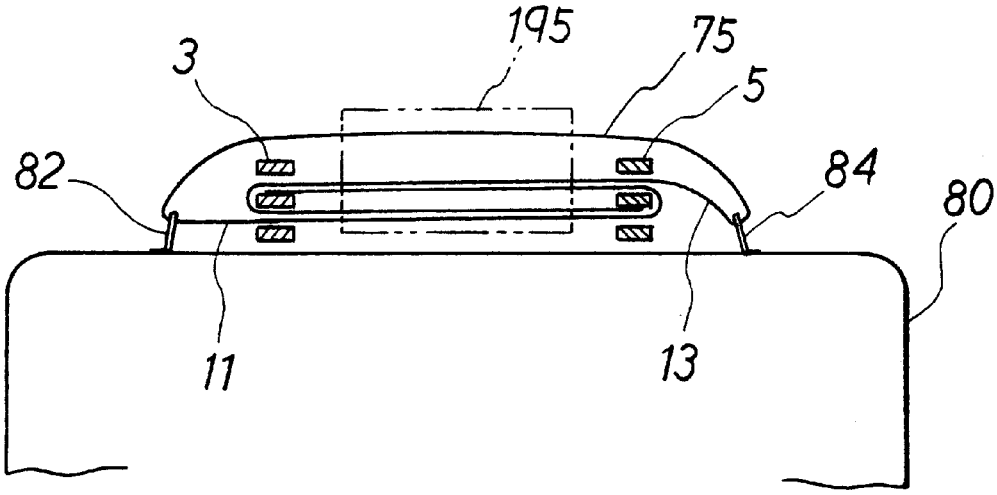
FIG. 10A shows a schematic view illustrating a structure of a bag equipped with a strap device according to a ninth embodiment of the present invention.
Figure 10B:
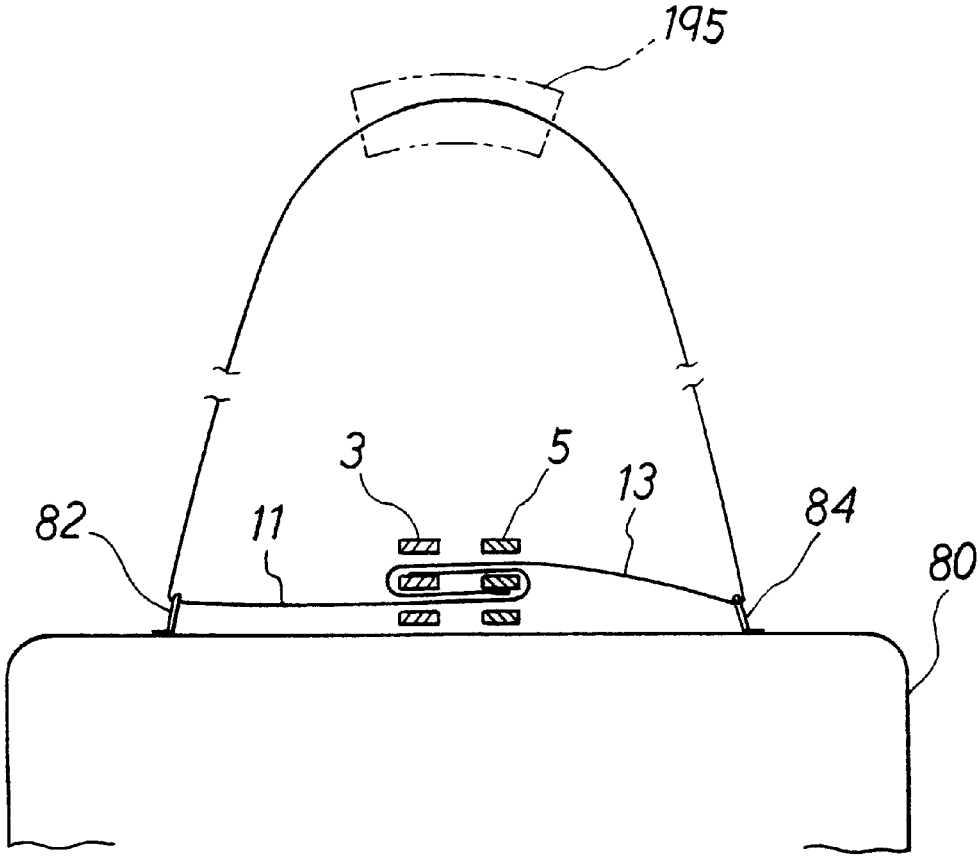
FIG. 10B shows a schematic view illustrating a state in which the strap device shown in FIG. 10A is extended.

An embodiment, in which a strap is successfully allowed to function as a grip, is shown in FIG. 10A as a modified embodiment of FIG. 4. As shown in FIG. 10A, a pad cover 195 is a cover made of, for example, leather, which can detachably cover a bundle of straps (11, 13, 75) which are quintuply overlapped. When the pad cover 195 covers the bundle of straps (11, 13, 75), the respective straps 11, 13, 75 cannot be moved, because they are restricted by the pad cover 195. Therefore, the pad cover 195 functions as the grip. When it is intended to use the straps as a shoulder strap, then the pad cover 195 may be detached from the strap bundle, and the strap 75 may be pulled up upwardly. Further, as shown in FIG. 10B, when the pad cover 195 is installed to a central portion of the pulled out strap 75, the pad cover 195 is successfully allowed to function as a shoulder pad. The second end of the strap 110 of each strap device may be directly connected to the pad cover 195.

Tenth Embodiment

Figure 11A:
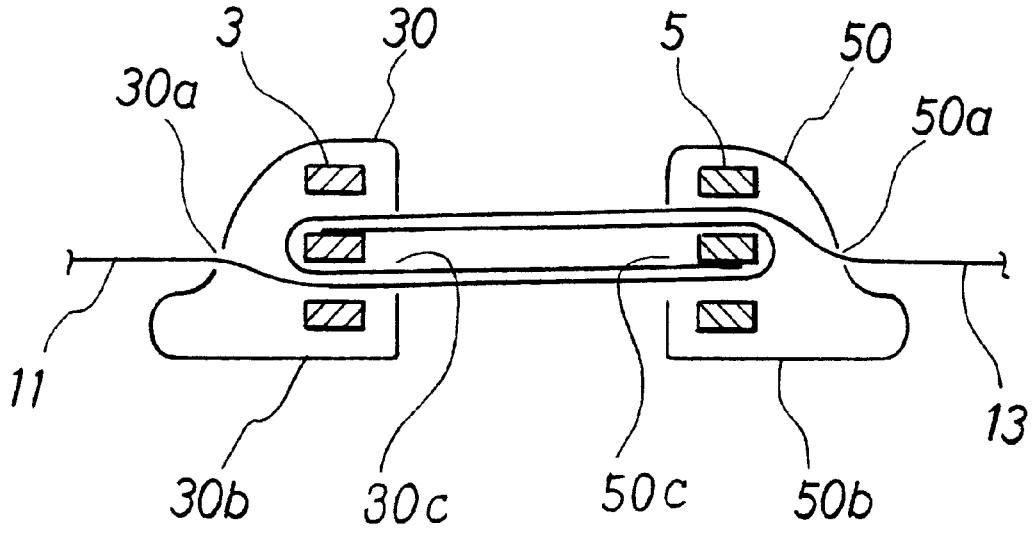
FIG. 11A shows a schematic view illustrating a state in which a strap device according to a tenth embodiment of the present invention is contracted.
Figure 11B:
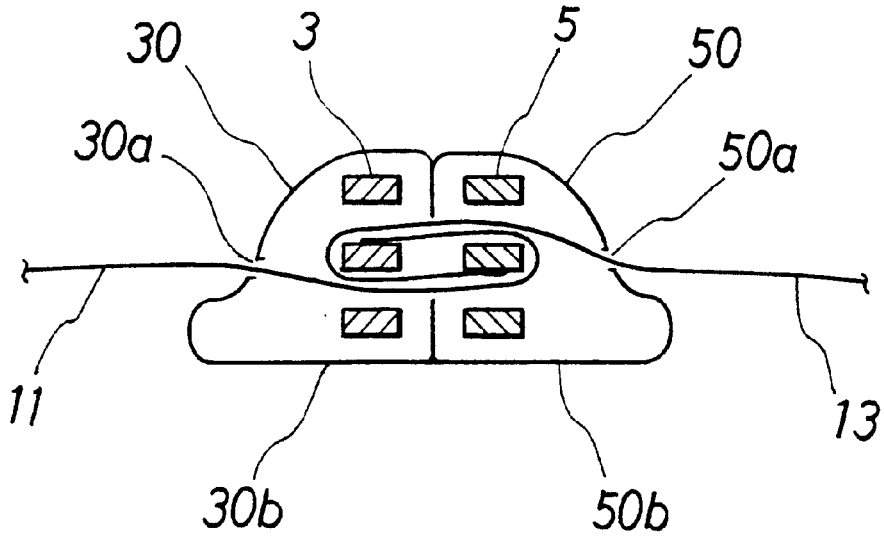
FIG. 11B shows a schematic view illustrating a state in which the strap device is extended.

In place of the provision of the pad 70, guides 3, 5 may be provided with pads, respectively, or may be formed integrally with the pads as a modified embodiment of the bag shown in FIG. 3. As shown in FIG. 11A, the entire guides 3, 5 are covered with guide covers (pads) 30, 50 formed of a flexible material such as rubber, except for strap passage windows 30*a*, 30*c*, 50*a*, 50*c*. When the straps 11, 13 are pulled out, then the guides 3, 5 make approach to one another, and the guide covers 30, 50 make tight contact with each other as shown in FIG. 11B. In this example, since the pads are attached to the respective guides 3, 5, a length of the strap 11 can be equal to that of the strap 13.

Eleventh Embodiment

Figure 12A:
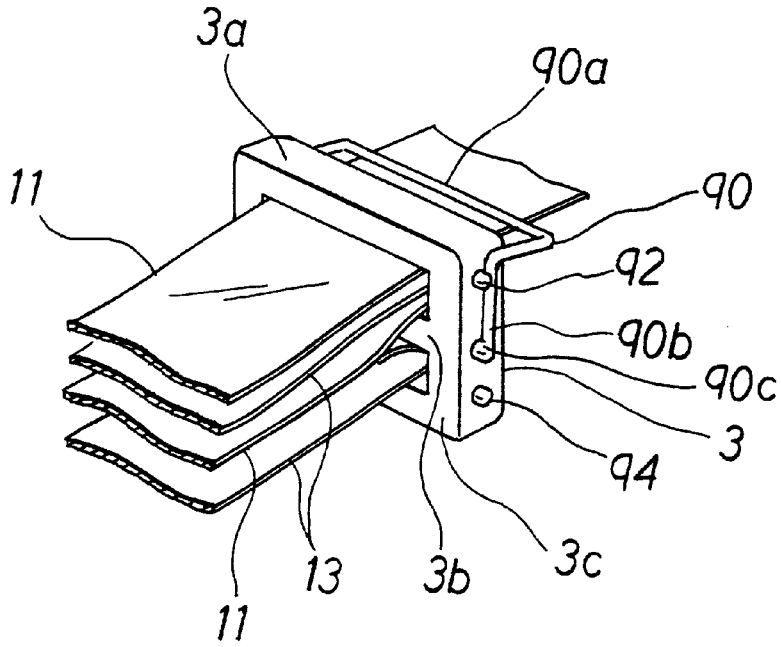
FIG. 12A shows a schematic view illustrating a state in which a guide to be used for a strap device according to an eleventh embodiment is unlocked.
Figure 12B:
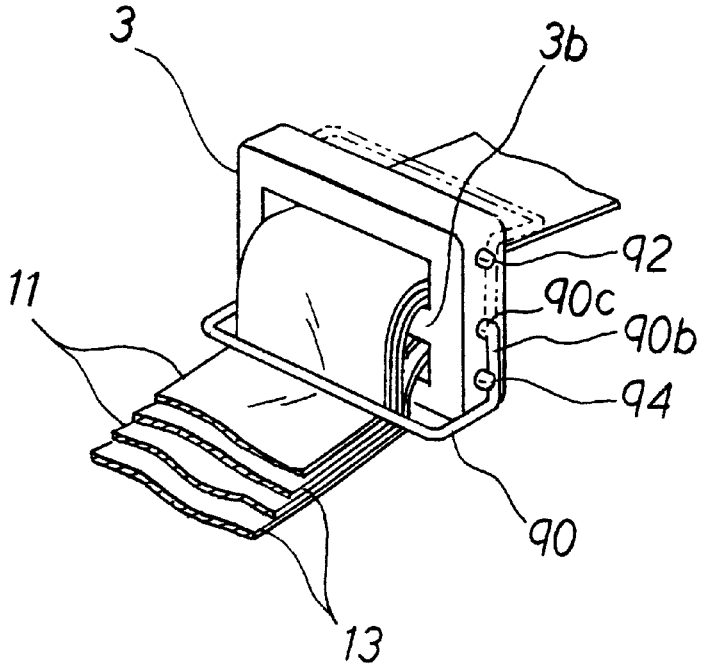
FIG. 12B shows a schematic view illustrating a state in which the guide is locked.

As shown in FIG. 12, a lock mechanism may be provided for only a guide 3. The lock mechanism has a lock arm 90 which is rotatable about the center of a rotary shaft 90*c* penetrating through a central member 3*b* of the guide 3, projections 92 which are provided on both side surfaces of an upper frame of the guide 3, and projections 94 which are provided on both side surfaces of a lower frame of the guide 3. The lock arm 90 is a rectangular frame. Arms 90*b*, which are connected to the rotary shaft 90*c*, are bent at intermediate positions so that L-shaped configurations are formed respectively, and they are connected to a lock bar 90*a* which traverses the straps. When the straps are made free from the guide 3 as shown in FIG. 12A, the arms 90*b* are prevented from counterclockwise rotation by the projections 92. Therefore, the straps 11, 13 are slidably movable with respect to the guide 3. On the other hand, when the straps 11, 13 are prohibited from the movement with respect to the guide 3, then the arms 90*b* are flexibly bent to ride over the projections 92 so that the arms 90*b* are rotated in the counterclockwise direction, and the arms 90*b* are further flexibly bent to ride over the projections 94 as shown in FIG. 12B. In this state, the lock bar 90*a* presses the strap bundle composed of the straps 11, 13. Therefore, it is impossible for the straps 11, 13 to make any sliding movement in the slits of the guide.

Twelfth Embodiment

Figure 13A:
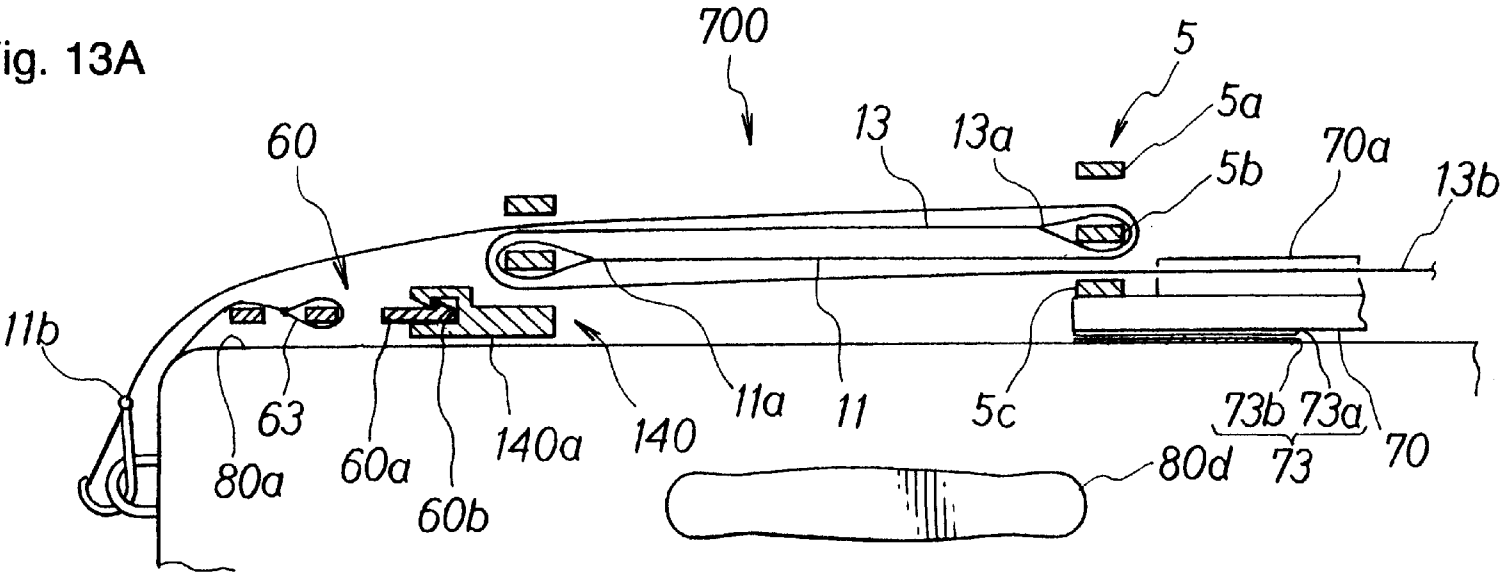
FIGS. 13A and 13B show top views of a bag illustrating a twelfth embodiment in which a lock adjuster is provided on a side wall of a main bag body.
Figure 13B:
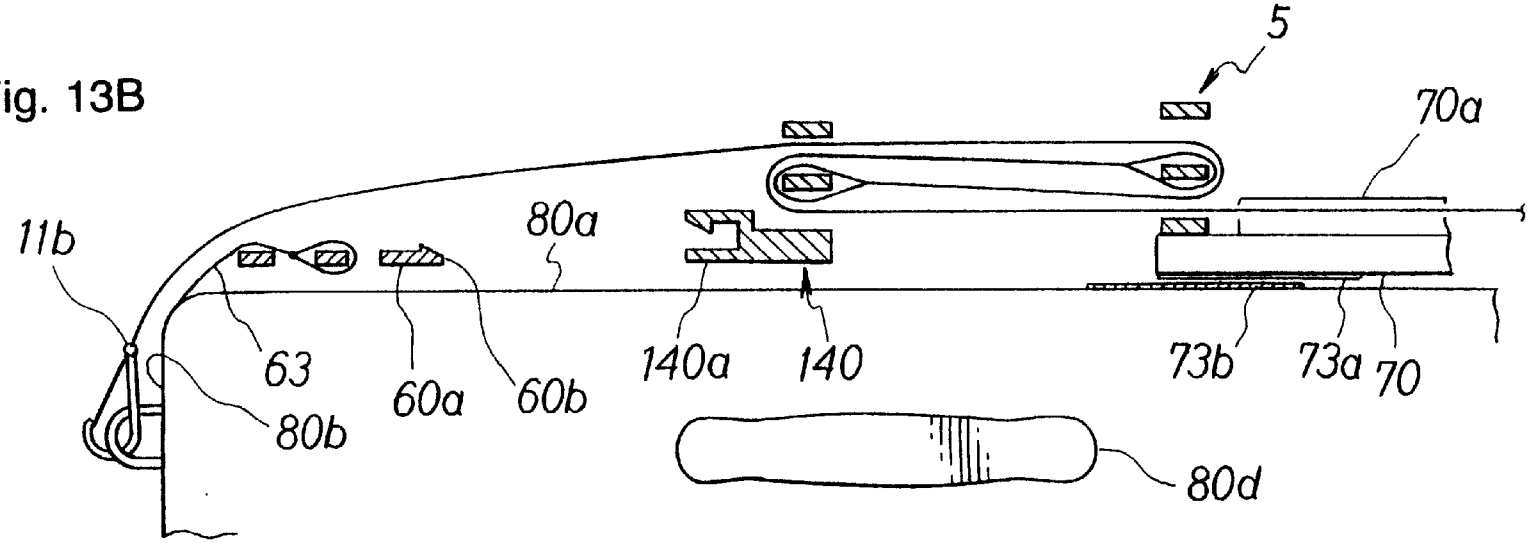
Figure 14A:
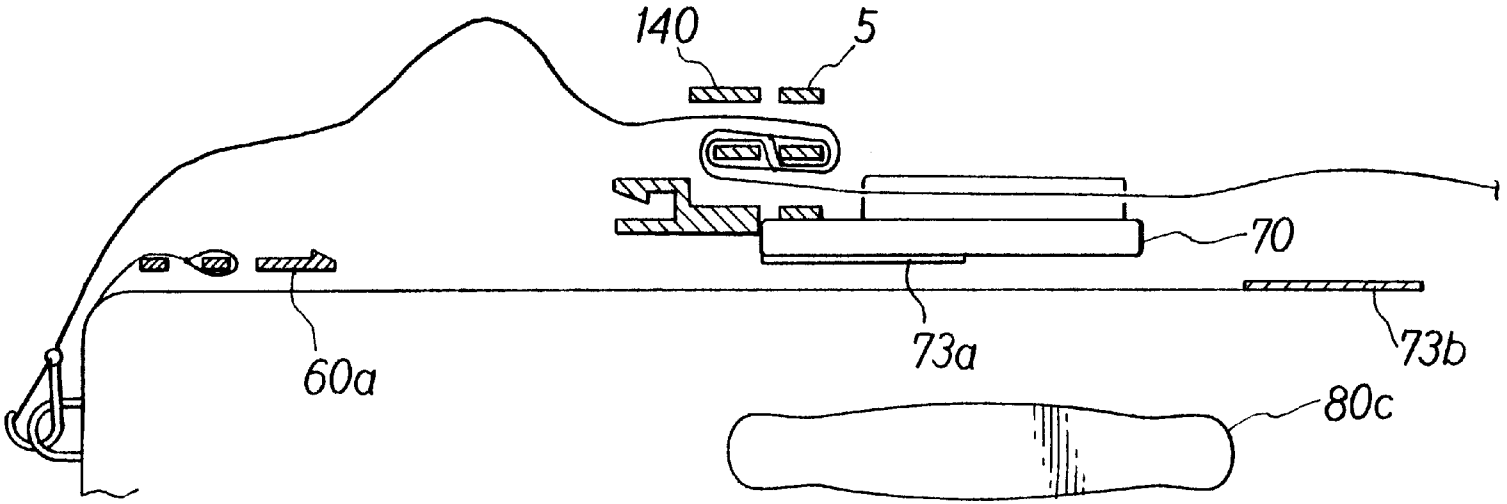
FIGS. 14A and 14B show top views illustrating operation performed when a strap is accommodated in the twelfth embodiment.

This strap device 700 shown in FIGS. 13A and 13B has approximately the same structure as that described in the sixth embodiment except that the lock adjuster 60 is provided on the main bag body 80, and an engaging section for making engagement with a lock pawl is provided for a lower frame 140 of a guide. An end of a main body 60*a* of the lock adjuster 60 is attached to a side wall section 80*a* of the main bag body 80 by the aid of a web 63. In a state in which the strap device 700 is contracted as shown in FIG. 13A, the lock pawl 60*b* of the lock adjuster 60 is engaged with the lower frame 140*a* of the guide 140, and the guide 140 is fixed to the lock adjuster 60. A first piece 73*a* of a Velcro tape 73 is adhered to the back surface of a pad 70. A second piece 73*b*, which adheres to the first piece 73*a*, is attached to the side surface 80*a* of the bag. The pad 70 is detachably attached to the side surface 80*a* of the bag by the aid of the Velcro tape 73. In order to pull out the straps from the strap device 700, the lock pawl 60*b* is flexibly deformed with respect to the main lock adjuster body 60*a* to disengage the lock pawl 60*b* from the lower frame 140*a* of the guide 40. Subsequently, as shown in FIG. 13B, the first piece 73*a* of the Velcro tape is disengaged from the second piece 73*b*, while the pad 70 is pulled in the direction to make separation from the lock adjuster 60 along the side surface 80*a* of the main bag body. As a result of this operation, the straps 11, 13 are pulled out from the area between the guides 140, 5. When the straps are completely pulled out, the guide 140 and the guide 5 are joined to one another and integrated into one unit as shown in FIG. 14A.

Figure 14B:
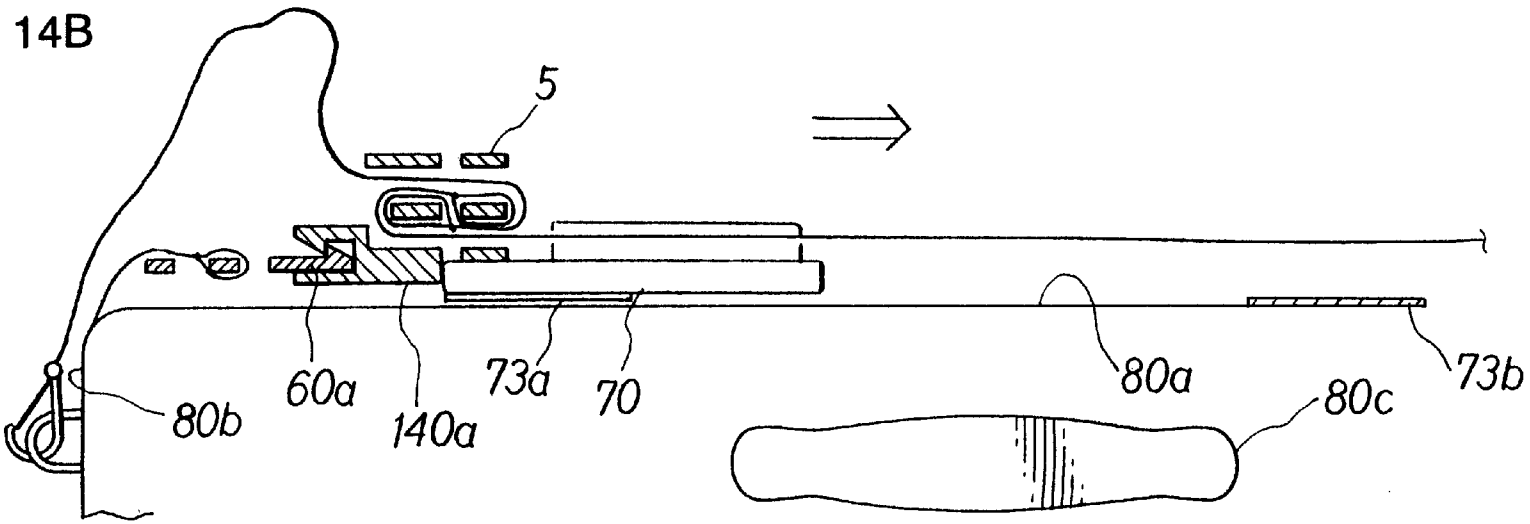

In order to shorten the pulled out straps, the user grips the pad 70 or the guide 5 with one hand to carry the guide 140 joined to the guide 5 to the lock adjuster 60 so that the lower frame 140*a* of the guide is engaged with the adjuster pawl 60*a* as shown in FIG. 14B. In this situation, the straps are in a state of being loosened as shown in FIG. 14. Subsequently, the user pulls the guide 5 in the direction to make separation from the guide 14 (direction of the arrow shown in the drawing) while gripping the pad 70 or the guide 5. Accordingly, the loosened straps are accommodated into the area between the guides 5, 140 to successfully make restoration to the state in which the guides 5, 140 are separated from each other as shown in FIG. 13A. The pad 70 can be fixed to the side surface 80*a* of the bag by adhering the first piece 73*a* of the Velcro tape to the second piece 73*b*. It should be noted that the user can retain the main bag body 80 by gripping a handle 80*c* of the bag with the other hand during the operation for shortening the straps as described above. That is, when the lock mechanism of this embodiment is used, the user can perform the extending/contracting operation for the straps with one hand, while gripping the handle 80*c* of the bag with another hand. Therefore, it is unnecessary to place the main bag body on the floor or on the chair during the extending/contracting operation for the straps. Especially, when the operation for contracting the straps is performed, it is enough to perform the two steps of (i) inserting the lock pawl 60*b* into the lower frame 140*a* of the guide, and (ii) pulling the guide 140. The simple two steps take only several seconds. It is intended that the side surface of the bag in this embodiment refers to the front face of the bag. However, the side surface of the bag may be the back face of the bag. When the strap device is provided on the front face of the bag, it is possible to give a functional design to the bag. When the strap device is provided on the back face of the bag, the design of the front face of the bag is not deteriorated by the strap.

Figure 17:
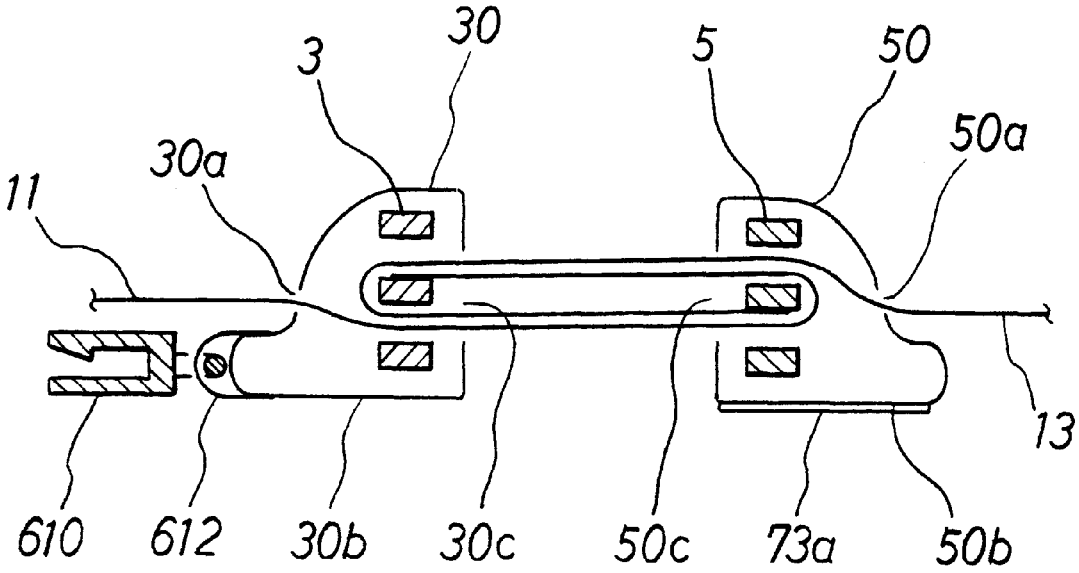
FIG. 17 illustrates a different strap device which may be provided on the bag shown in FIG. 16.
Figure 18A:
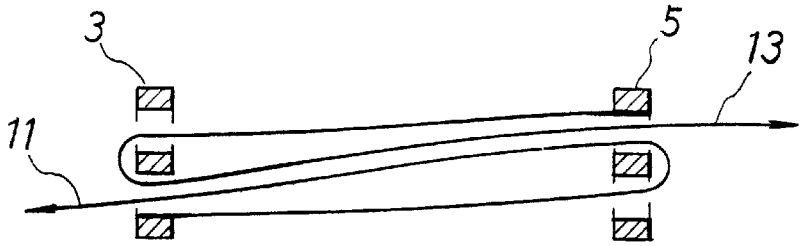
FIGS. 18A to 18E conceptually show a variety of passage ways for straps to pass through the guides in the strap device of the present invention.
Figure 18B:
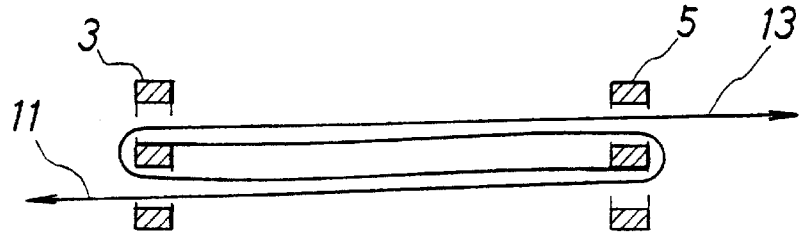
Figure 18C:
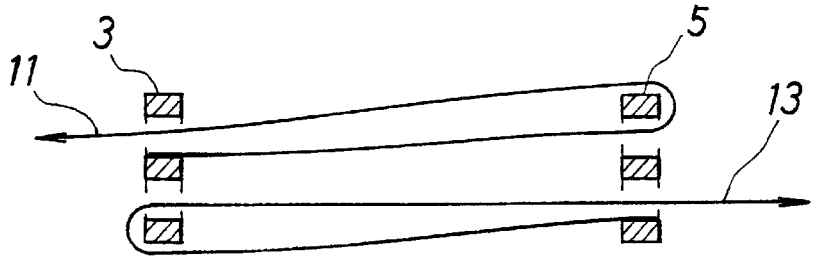
Figure 18D:
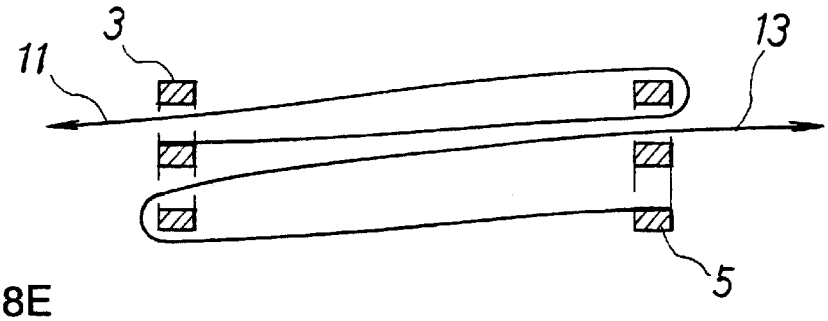
Figure 18E:
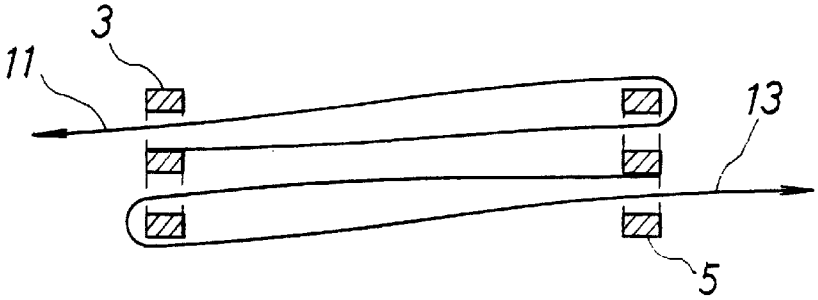

In a modified embodiment of the twelfth embodiment, a strap device as shown in the tenth embodiment may be used in place of the strap device 700. In this case, as shown in FIG. 17, an engaging section 610, which is engageable with the lock pawl 60*b*, can be attached through a tape 612 (or directly) to the bottom surface on the side of the strap passage window 30*a* of the guide cover 30. The second piece 73*b* of the Velcro tape may be attached to the bottom surface of the guide cover 50.

Figure 15A:
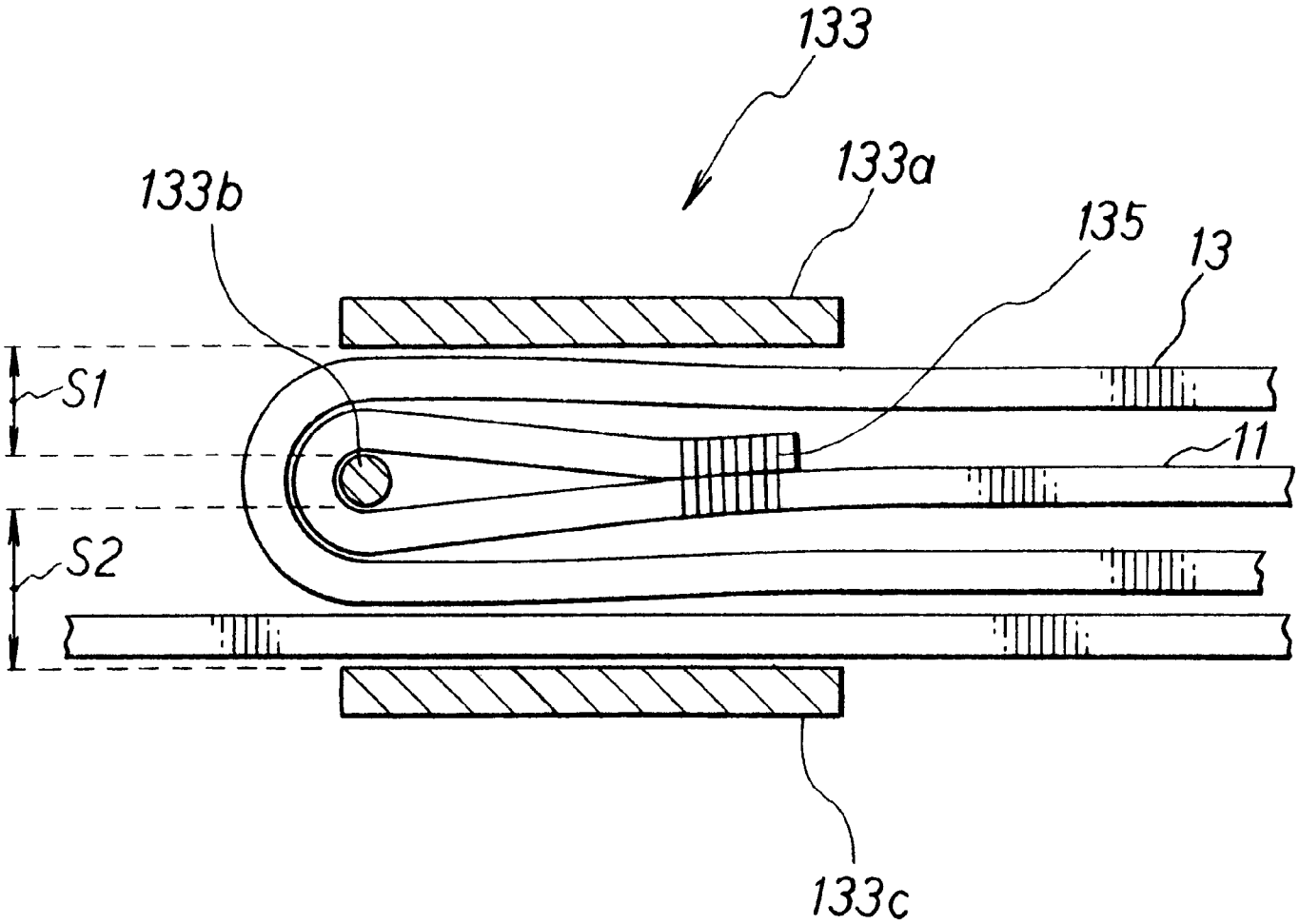
FIG. 15A shows a sectional view illustrating an exemplary structure of a guide to be used for the strap device.
Figure 15B:
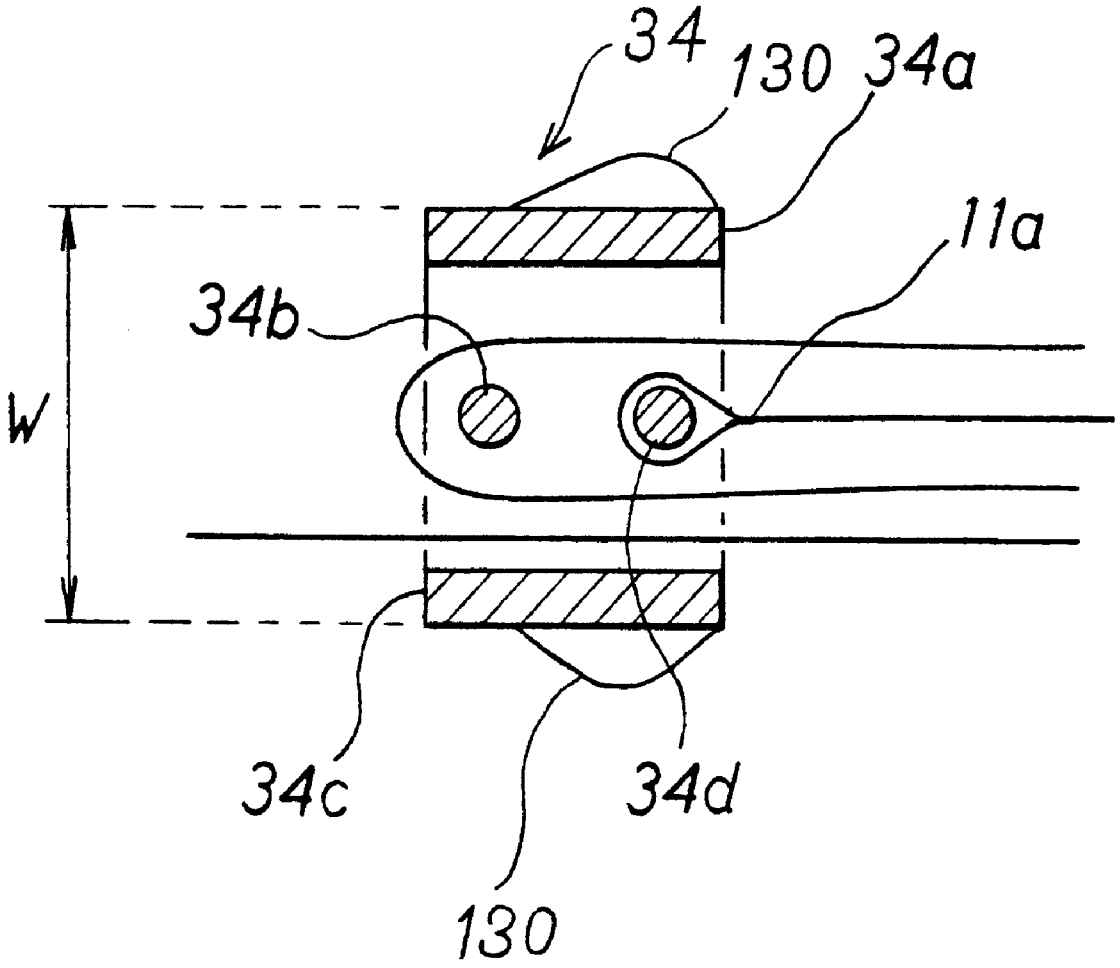
FIG. 15B shows a sectional view illustrating another exemplary structure of a guide.

The guide, which has been described and explained in the foregoing embodiments, may have structures as shown in FIGS. 15A and 15B. A guide 133 shown in FIG. 15A has a central member 133*b* around which the strap is wound. The central member 133*b* is provided in the guide so that the central member 133*b* is offset toward the outlet side of the guide (left side in the drawing) in the lengthwise direction of the guide. Especially, in this embodiment, the central member 133*b* is provided at the outlet end of the guide, for the following reason. According to experiments performed by the present inventor, when the strap is sewed up in a state in which the strap is wound around the central member 133*b* of the guide, a seam 135 is separated from the central member 133*b* (margin for the seam). For this reason, when the first guide 133 is joined to the second guide 133, there is some possibility that the seam 133*b* may enter the slit of the second guide 133. Such a situation arises due to the fact that any margin for the seam is necessarily required when the seam 135 is formed by using a sewing machine. In order to avoid such an inconvenience, the guide, in which the central member 133*b* is provided at the outlet end of the guide as shown in the drawing, may be used such that the strip is sewed up at the outside of the guide, and the seam 135 is accommodated in the guide 133 thereafter.

In this case, it is desirable that the spacing distance S1 of the slit, which is formed between the central member 133*b* and the upper frame 133*a* of the guide, has a width so that the two straps pass therethrough to such an extent that the straps are not loosened with respect to the guide. For example, it is desirable that the spacing distance S1 has a width which is larger than the double of the thickness of the strap by about 0.2 mm to 1 mm. It is desirable that the spacing distance S2 of the slit, which is formed between the central member 133*b* and the lower frame 133*c* of the guide, has a width so that the three straps pass therethrough to such an extent that the straps are not loosened with respect to the guide. For example, it is desirable that the spacing distance S2 has a width which is larger than the triple of the thickness of the strap by about 0.2 mm to 1 mm. It is desirable that S1 and S2 are related such that S2 is larger than S1 by not less than the thickness of the strap. In place of the arrangement in which S1 and S2 are different from each other as described above, when the end portion of the strap is folded doubly or more to stitch the folded end portion and the strap together, an obtained stitched portion has a thickness which is not less than size of the slit. Accordingly, the seam is prevented from invasion into the slit.

Alternatively, when the margin for the seam can be shortened, the central member may be constructed with mutually independent columnar members for a section 34*d* to which the first end 11*a* of the strap is connected and a section 34*b* around which the strap is wound as in a guide 34 shown in FIG. 15B. When this arrangement is adopted, then it is possible to obtain a thin thickness W of the guide (guide width in a direction perpendicular to the direction in which the strap is extended), and the strap is moved more smoothly. Further as shown in FIG. 15B, in order to easily perform the operation for pulling away the pair of guides from each other, projections 130 may be provided for an upper frame 34*a* and a lower frame 34*c* of the guide, and the projections 130 can be used to function as a grip. It is effective that the projections are provided on side surfaces (lateral frames) of the guide.

Figure 16:
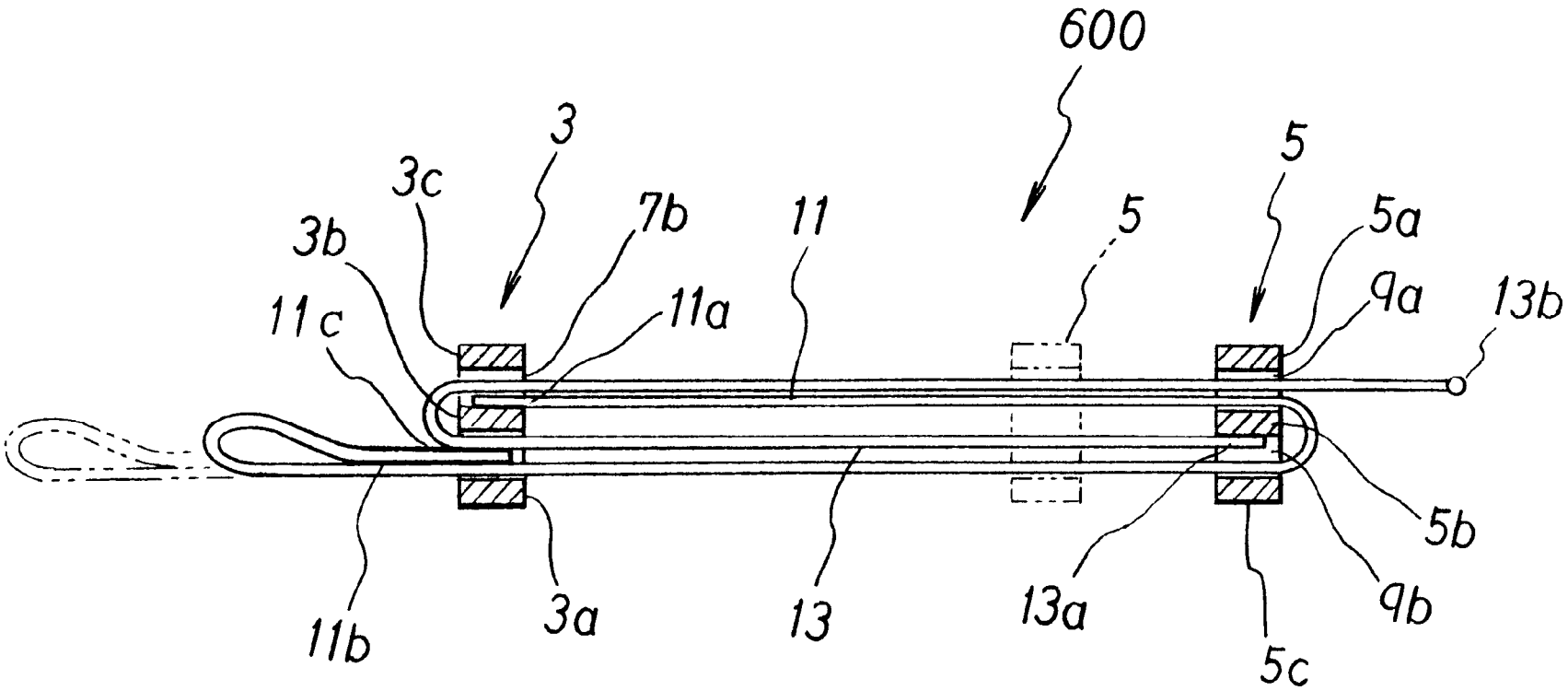
FIG. 16 illustrates a structure and operation of a lock mechanism to be used for the strap device of the present invention.

In place of the lock mechanisms shown in FIGS. 7A, 7B, 8A, and 8B, a structure may be adopted as shown in FIG. 16, in which the second end 11*b* of the strap is folded back to form a section ll*c* at which the strap thickness is increased so that the section 11*c* is inserted into the slit of the guide to make engagement as shown in FIG. 16. This structure enables the strap to be locked by the guide extremely easily. This structure is especially useful for the strap for the portable telephone shown in FIG. 5. In place of the overlapped strap, a member, which is insertable into the slit portion of the guide, may be provided in the vicinity of the second end of the strap so that the member is detachable or the position of the member is changeable. This member may be secured to an adjuster (not shown) for regulating the length of the strap.

FIGS. 18A–18E show a variety of patterns to be adopted for the straps 11, 13 to pass through the slits of the guides 3, 5 in the strap device of the present invention. Any one of the patterns is included in any one of the forms of the strap device of the present invention as defined in claims. Among them, in view of the intention to avoid the twist or entwinement of the straps 11, 13 when they are pulled out from the guides 3, 5, it is especially advantageous to use the pattern shown in FIG. 18B which is equivalent to one shown in FIG. 7A.

The present invention has been explained above as exemplified by the embodiments. However, the present invention includes a variety of modified embodiments of the embodiments. For example, the strap device of the triple elongation mode shown in FIG. 6 may be used as a strap for the bag or portable telephone shown in other embodiments. Further, the exemplified lock mechanism may be provided for the strap devices (for example guide 5) shown in FIGS. 4, 6, 8, 9 and 10. Those usable as the material for the strap include leather, artificial leather, and cloth. When a flexible material such as cloth is used, a core material such as gut may be inserted into the interior of the material in order to avoid any twist or entwinement of the strap. The strap device of the present invention is usable for a variety of ways of use in which the extendable/contractible function is conveniently adopted, including, for example, reins or bridles for animals, electric cords, chin straps for caps and helmets, cords for glasses, and belts for clothes such as overcoats.

The strap of the present invention can be extended extremely easily to have the length which is the quadruple of the length obtained when the strap is contracted. Therefore, the strap of the present invention is preferably used for a variety of ways of use, including, for example, straps for bags and portable telephones. The strap of the present invention can be produced at low cost, because its structure is simple. As for the bag of the present invention, when the strap is not used, the strap is contracted to have the length at which the strap does not hang down from the main bag body. When the strap is required, the strap can be instantaneously stretched to have the sufficient length. On the other hand, the strap can be contracted easily and instantaneously.

What is claimed is:

1. An extendable/contractible strap device comprising:

a first guide which is formed with first and third slits;

a first strap which has a first end connected to the first guide;

a second guide which is arranged opposingly to the first guide and which is formed with second and fourth slits; and a second strap which has a first end connected to the second guide, wherein:

the first strap has a second end which passes through at least one of the second slit and the fourth slit, which returns to the first guide, and which subsequently passes through one of the first slit and the third slit of the first guide, and the second strap has a second end which passes through at least one of the first slit and the third slit, which returns to the second guide, and which subsequently passes through one of the second slit and the fourth slit of the second guide.

2. The strap device according to claim 1, wherein the first end of the first strap is connected to a central member which is defined between the first slit and the third slit, and the first end of the second strap is connected to a central member which is defined between the second slit and the fourth slit.

3. The strap device according to claim 1, wherein the second end of the first strap passes through the second slit and the fourth slit, returns to the first guide, and subsequently passes through the third slit, and the second end of the second strap passes through the third slit and the first slit, returns to the second guide, and subsequently passes through the second slit.

4. The strap device according to claim 1, wherein the first and second straps are overlapped doubly between the first guide and the second guide respectively, and the first guide and the second guide make approach to one another by pulling away the second ends of the first and second straps in directions in which the second ends are separated from each other.

5. The strap device according to claim 1, further comprising a lock member which is disposed in the vicinity of the second end of the first or second strap and which prevents at least one strap of the first and second straps from movement.

6. The strap device according to claim 1, wherein the strap device is a shoulder strap, and a member, which is attachable/detachable with respect to an object, is attached to each of the second ends of the first and second straps.

7. The strap device according to claim 6, wherein the second strap is longer than the first strap by a predetermined length.

8. The strap device according to claim 7, further comprising a pad which is formed with a passage for allowing the strap to pass therethrough, wherein the second strap passes through the passage.

9. The strap device according to claim 6, further comprising first and second pads which are attached to the first and second guides respectively.

10. The strap device according to claim 6, wherein the object is one of a bag, a camera, and a telescope.

11. The strap device according to claim 1, wherein the second end of the first strap is connected to an object, and a clip is provided at the second end of the second strap.

12. The strap device according to claim 11, wherein the object is a portable telephone or a key.

13. The bag according to claim 12, wherein the second strap is longer than the first strap by a predetermined length.

14. The bag according to claim 13, further comprising a pad which is formed with a passage for allowing the strap to pass therethrough, wherein the second strap passes through the passage.

15. A bag comprising a main bag body and the strap device as defined in claim 1, wherein the second ends of the first strap and the second strap are attached to a surface of the main bag body respectively.

16. The bag according to claim 15, further comprising first and second pads which are attached to the first and second guides respectively.

17. The bag according to claim 15, further comprises first and second pads provided on the first and second guides, a lock member attached to the main bag body, and an engaging member which is attached to the first pad and detachably engages with the lock member.

18. The bag according to claim 15, further comprising a lock mechanism which locks at least one of the first guide and the second guide with respect to the first or second strap or the main bag body.

19. The bag according to claim 18, wherein the lock mechanism comprises a lock member which is attached to the first strap, and an engaging member which is attached to the first guide and which detachably engages with the lock member.

20. The bag according to claim 18, wherein the lock mechanism comprises a lock member which is attached to the main bag body, and an engaging member which is attached to the first guide and which detachably engages with the lock member.

21. The bag according to claim 18, wherein the lock mechanism has a lock member which is rotatably attached to the first guide or the second guide and which fastens at least one of the first and second straps depending on a position of rotation.

22. An extendable/contractible strap device comprising:

a first guide which is formed with a first slit;

a first strap and a second strap which have first ends connected to the first guide respectively; and a second guide which is arranged opposingly to the first guide and which is formed with a second slit, wherein:

the first strap has a second end which passes through the second slit, which returns to the first guide, and which subsequently passes through the first slit, and the second strap has a second end which passes through the second slit.

23. A bag comprising a main bag body and the strap device as defined in claim 22, wherein the second ends of the first strap and the second strap are attached to a surface of the main bag body respectively.

* * * * *